US006095055A

United States Patent [19]

Lohr et al.

[11] Patent Number: 6,095,055

[45] Date of Patent: Aug. 1, 2000

[54] SEPARABLE RAIL TRANSPORT UNIT FOR CARRYING A LOAD, PARTICULARLY A ROAD UNIT

[75] Inventors: Robert Lohr, Hangenbieten; Didier Ganter; Bruno Martin, both of Strasbourg; Jean-luc Andre, Obernai, all of France

[73] Assignee: Lohr Industrie, Hangenbieten, France

[21] Appl. No.: 08/193,203

[22] PCT Filed: Aug. 21, 1992

[86] PCT No.: PCT/FR92/00816

§ 371 Date: Apr. 18, 1994

§ 102(e) Date: Apr. 18, 1994

[87] PCT Pub. No.: WO93/03945

PCT Pub. Date: Mar. 4, 1993

[30] Foreign Application Priority Data

| | | | |
|---|---|---|---|
| Aug. 21, 1991 | [FR] | France | 91 10590 |
| Mar. 4, 1992 | [FR] | France | 92 02763 |
| Mar. 4, 1992 | [FR] | France | 92 02764 |

[51] Int. Cl.[7] ..... B61D 47/00; B61D 3/16

[52] U.S. Cl. ..... 105/4.2; 105/355; 105/159

[58] Field of Search ..... 105/4.2, 4.3, 355, 105/159; 410/53, 54

[56] References Cited

U.S. PATENT DOCUMENTS

| | | | |
|---|---|---|---|
| 2,246,543 | 1/1941 | Smith | 105/159 |
| 4,653,966 | 3/1987 | Bakka et al. | 410/53 |
| 5,216,956 | 6/1993 | Adams, Jr. | 105/4.2 |
| 5,222,443 | 6/1993 | Engle | 105/355 |
| 5,564,341 | 10/1996 | Martin | 105/4.2 |

FOREIGN PATENT DOCUMENTS

| | | |
|---|---|---|
| 293359 | 11/1988 | European Pat. Off. . |
| 403021 | 12/1990 | European Pat. Off. . |
| 465277 | 1/1992 | European Pat. Off. . |
| 3234374 | 3/1984 | Germany . |
| 8905253 | 6/1989 | WIPO . |

*Primary Examiner*—S. Joseph Morano
*Attorney, Agent, or Firm*—Davis and Bujold

[57] ABSTRACT

A rail transport unit for carrying a load consisting of a road vehicle includes a support structure having two longitudinal ends. Each end is connected to an axle block or bogie by a composite interface, and at least one of the ends is free and defines an access opening for the load.

45 Claims, 25 Drawing Sheets

SEPARABLE RAIL TRANSPORT UNIT FOR CARRYING A LOAD, PARTICULARLY A ROAD UNIT

The present invention relates to a separable rail transport unit for carrying a road-going load consisting in particular of a fully or partially assembled road unit.

This rail transport unit includes a carrier structure known as a freight car structure resting, so as to be removable by both or by one or other of its ends, on two axle units or bogies by means of interfaces.

It permits the rapid loading notably of one or more towed, mounted or semi-mounted road units, swap bodies, containers or the like.

The transportation of containers and semi-trailers on railroad carrier structures connecting two axle units or bogies is known.

First, where containers are concerned, they are stowed on these structures by means of their ISO-standard corner fittings on projecting lateral supports, each carrying a rotary locking device.

These containers are loaded and unloaded by means of grapplers carried and used by cranes, gantries, travelling machines such as lift trucks or other handling means.

As far as trailers and semi-trailers are concerned, transverse receiving structures carry the running gear at the rear, whilst the coupling pivot is held at the front by a similar support or one constituting an equivalent of the articulation support conventionally known as a trailer dolly on articulated semi-trailer road units.

If the load is held correctly, carrying out the loading and unloading operations hardly ever proves to be easy, because of the cumbersome means used and the accuracy in relative positioning which needs to be observed for stowage.

Loading/unloading operations have also been carried out by the lateral translational movement of a freight car platform between a loading dock and a railroad receiving structure or freight car.

By way of illustration, the freight car structure described in the German patent No DE 3139220, the two ends of the platform of which are slides which are lateral with respect to the axle units or bogie(s), can be cited.

To bring this freight car structure into its loading or unloading position, it is necessary to stop it along a specially arranged external loading surface, then to move the platform in translational motion transversely to the chassis and cause it to rest on the loading surface.

According to this invention, the loading surface is specially raised to bring it to the level of the platform.

Also according to this invention, only the carrier platform is moved, and not the entire structure.

Implementations in accordance with this invention have the drawback of requiring a complex freight car structure, specially adapted for transfers.

These costly and non-universal means are not appropriate for all types of load.

Another drawback lies in the height of the loading surface, access to which is not necessarily compatible with the level of the freight car platform.

The aim of the present invention is to mitigate the above drawbacks by proposing a railroad carrier structure which is easy to manufacture, enabling loading/unloading operations to be carried out rapidly and without difficulty.

In addition, for the purpose of facilitating uncoupling and the placing of the load in an out-of-line position, provision is made for it to be equipped, at one of its ends at least, with lifting means associated with travelling means for the purpose of lateral movement by pivoting about the opposite end.

To this end, the rail transport unit according to the invention comprises a carrier structure connecting two axle units or bogies for the transportation of a load or cargo of a road-going type, in particular a fully or partially assembled road unit, said carrier structure being mounted on each of the axle units or bogies by means of a composite interface transmitting the traction forces and shocks, at least one end of the carrier structure being open so as to define an access passage, said carrier structure being mounted so as to be directly or indirectly separable as a whole from the interface of at least one axle unit or bogie with a view to leaving a completely free passage for the road-going load or cargo for the purpose of its access onto or into the carrier structure through the access opening.

The advantages of the invention prove to be numerous. The following may be cited in particular:

- the possibility of unloading even onto docks which do not have any handling equipment;
- the possibility of loading/unloading whatever the level of the dock;
- the speed of the preparatory and loading/unloading operations;
- the ability to receive all types of load.

Furthermore, because of the separable nature of the carrier structure according to the invention, and in accordance with the particular embodiment, at the front and at the rear, it is possible to envisage its removal when empty or laden, by the simple vertical movement of an external lifting device, to extract it from a railroad train, in order to insert it directly into another railroad train nearby, or to deposit the carrier structure on a dock for the purpose of loading or unloading.

The specific means of a particular embodiment enable it to relate to two other ways of carrying out loading or unloading operations: in line or obliquely. The latter solution affords a considerable saving in time over the total time taken to load a railroad train.

Several non-limitative embodiments of the separable freight car structure in accordance with the invention will be described below in more detail, with reference to the accompanying drawings in which.

Figure 5:
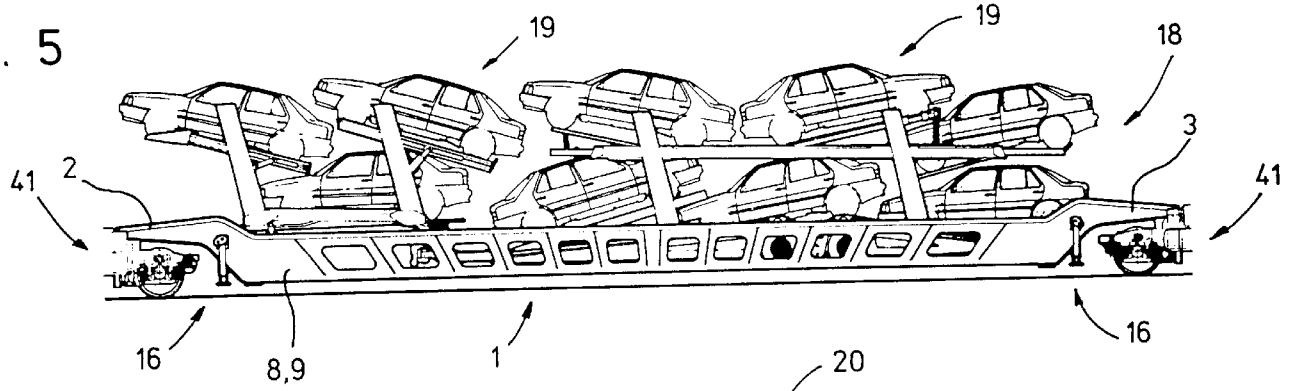
Figure 6:
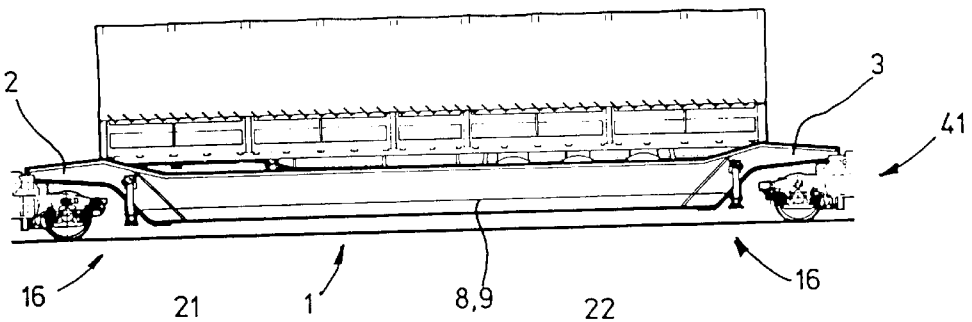
Figure 7:
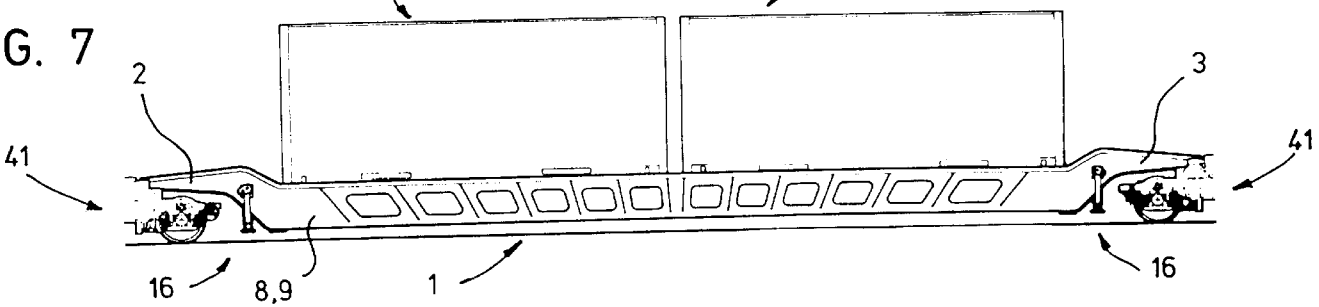
Figure 11:
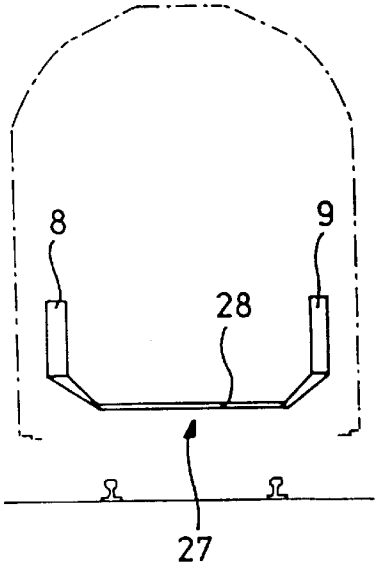
Figure 10:
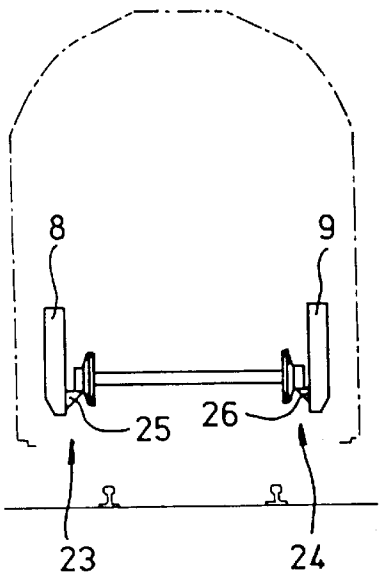
Figure 9:
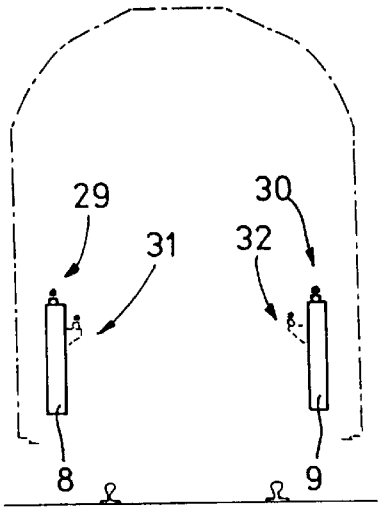
Figure 8:
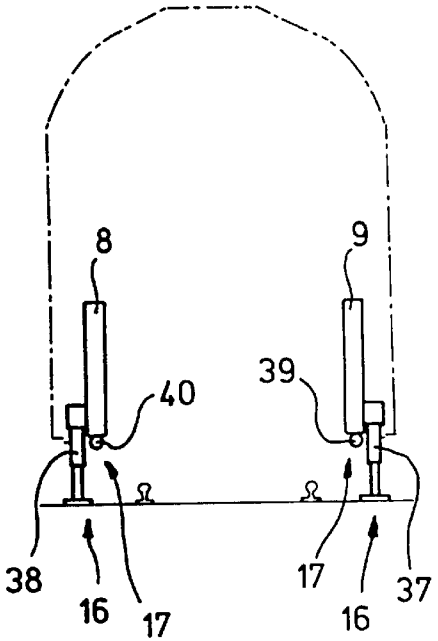
Figure 12:
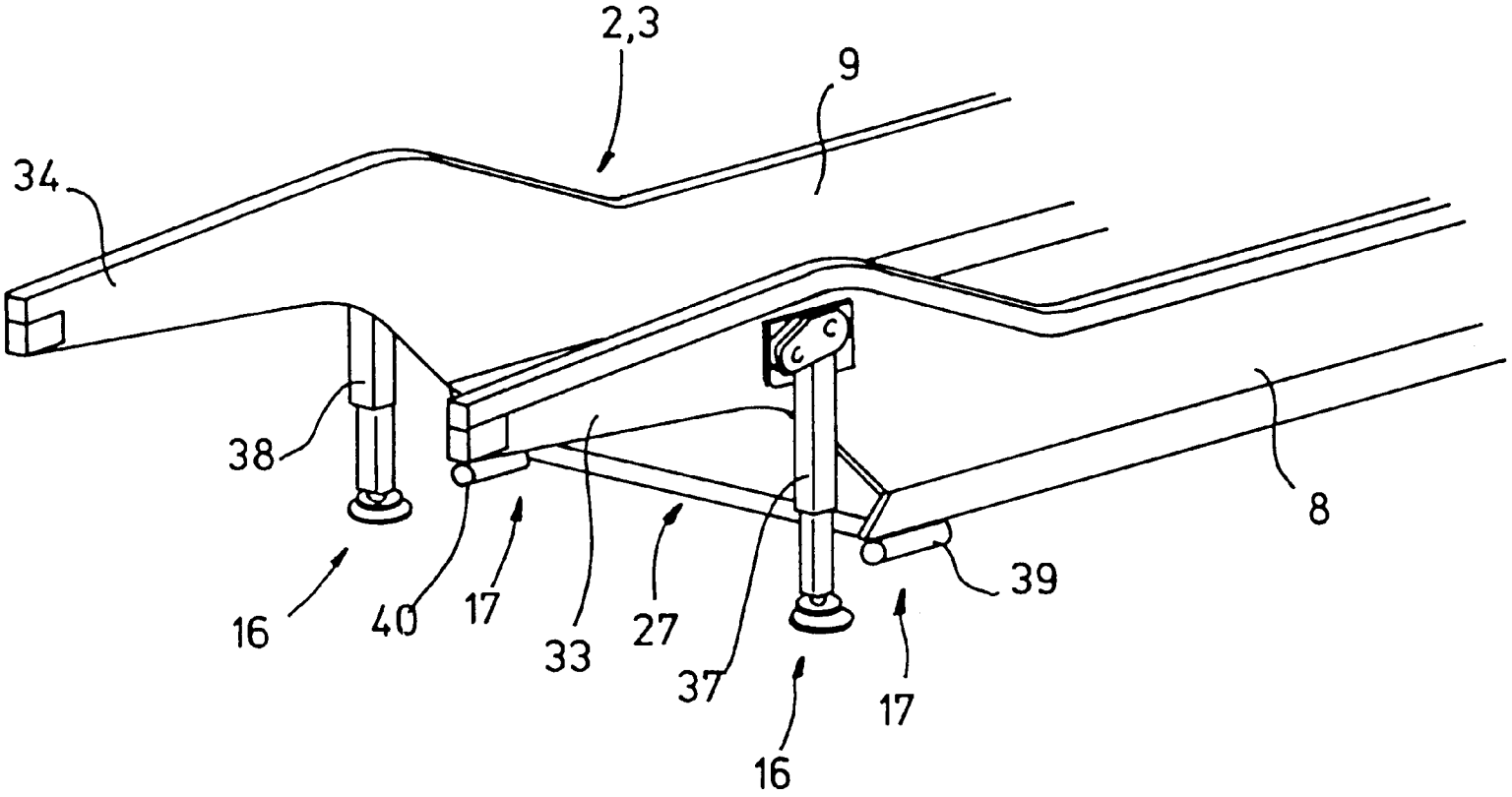
Figure 13:
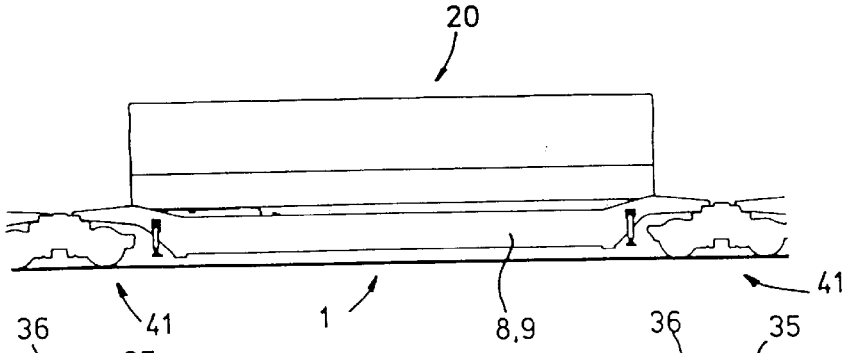
Figure 14:
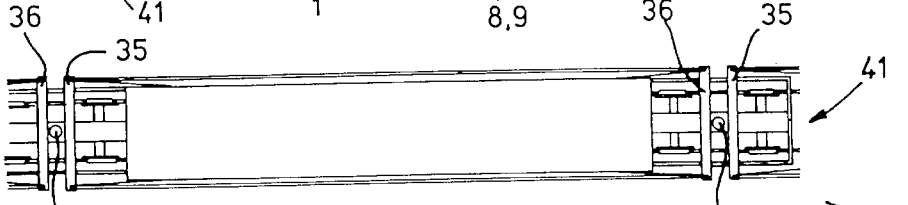
Figure 15:
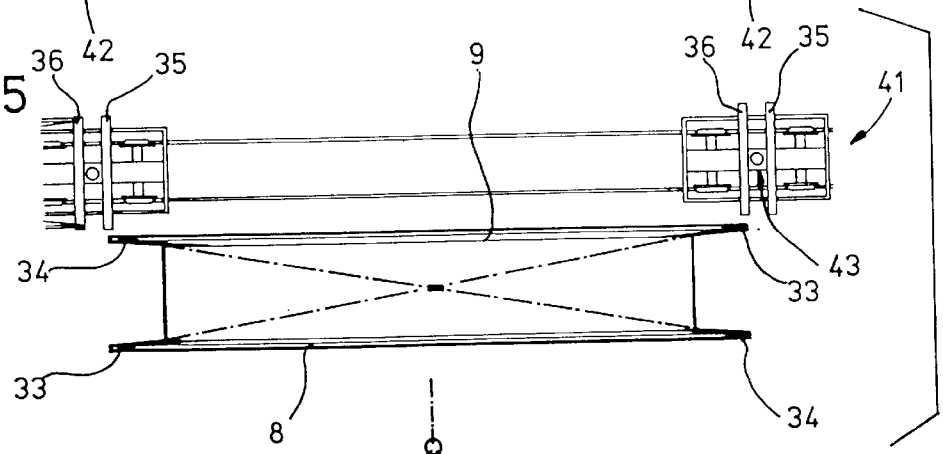
Figure 16:
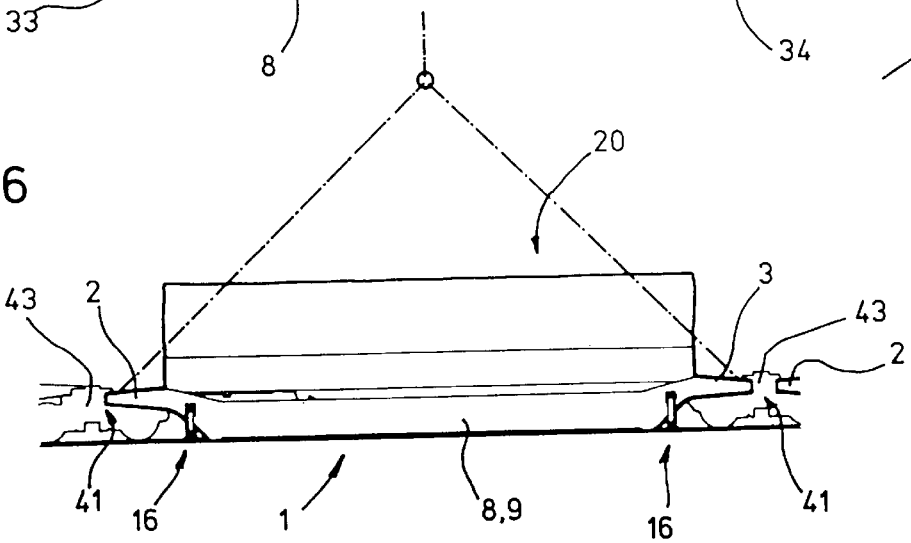
Figures 17, 18, 19, 20, 21, 22:
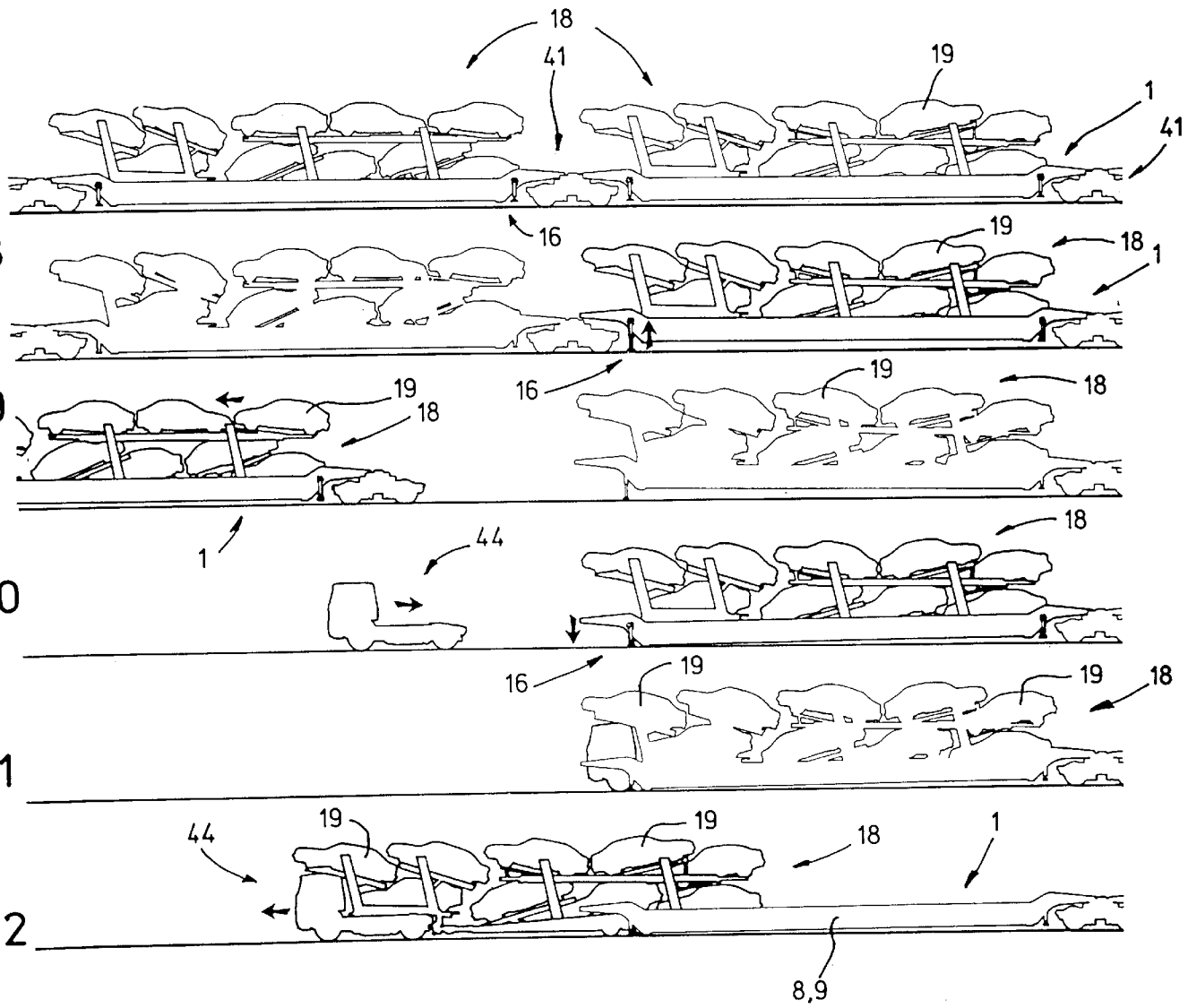
Figures 23, 24, 25:
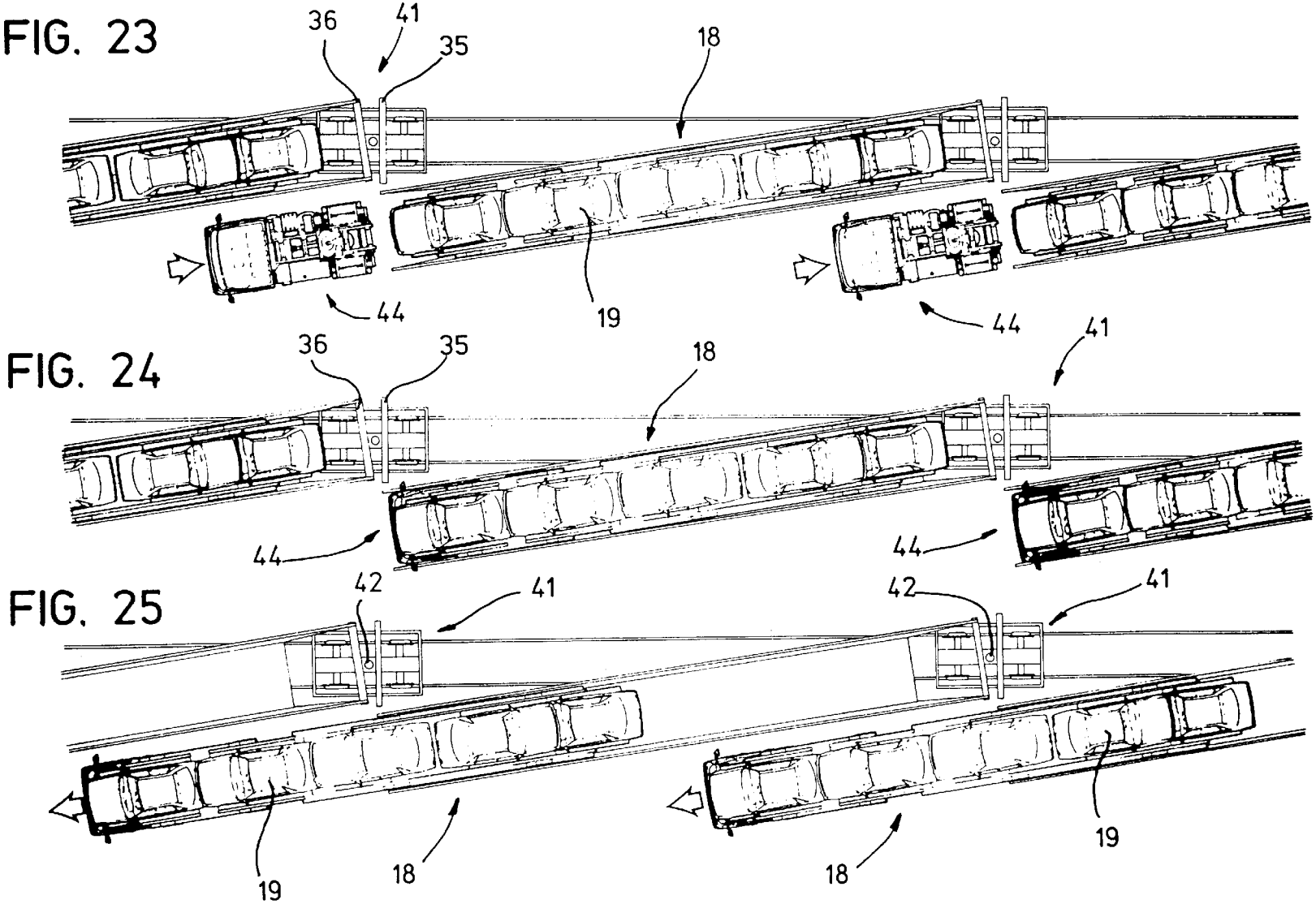
Figure 26:
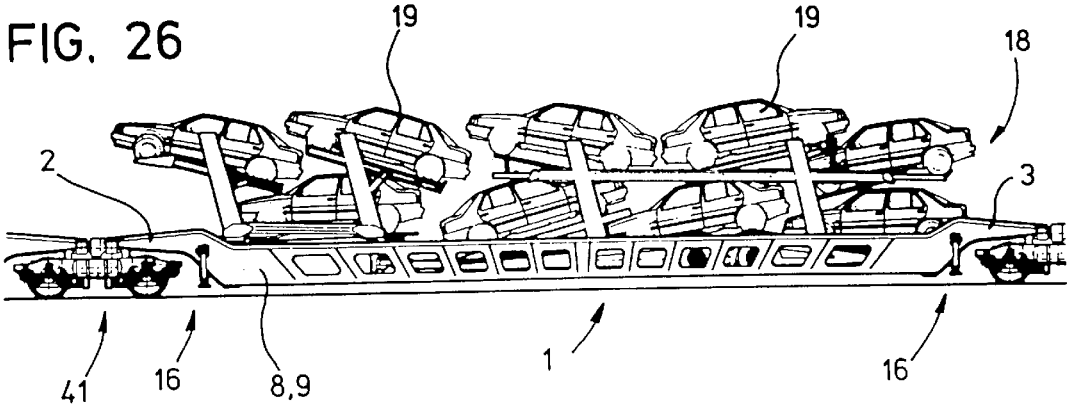
Figure 27:
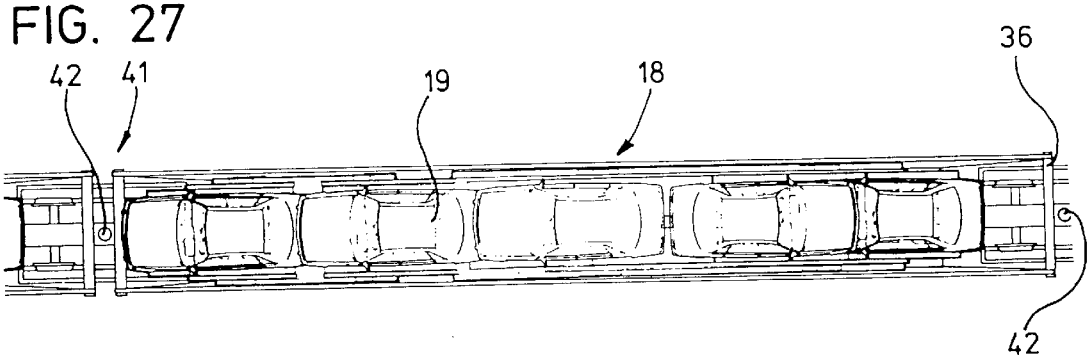
Figure 28:
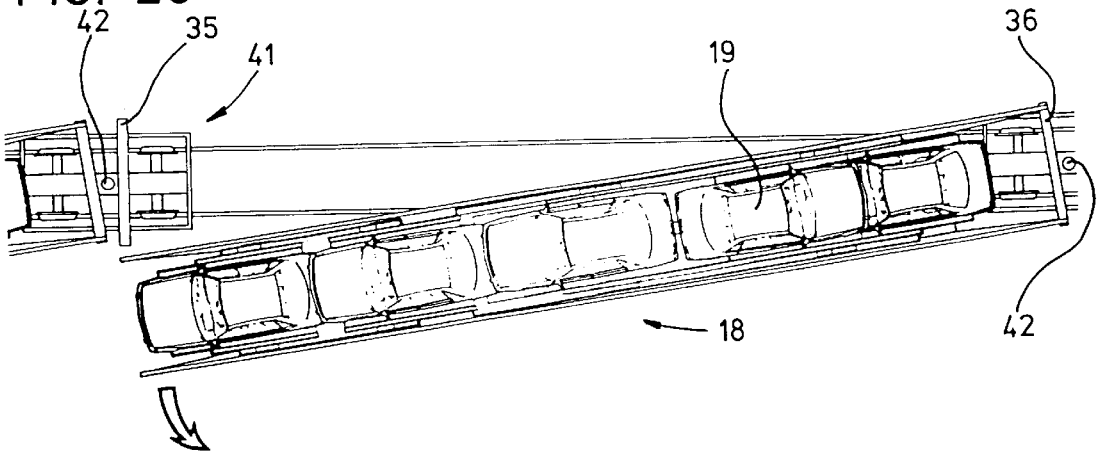

- with buffer and coupling hook on the interface,
- with axle unit or bogie common to both ends,
- with common axle unit or bogie, common interface and common pivot axis;

FIGS. 5, 6 and 7 are side views illustrating examples of applications respectively to vehicle-carrying road-going structures, to a semi-mounted trailer and to containers;

FIG. 8 is a view in cross section illustrating one of the integral lifting means in the form of props, with the overall outline shown in a dot-and-dash line;

FIG. 9 is a view in cross section showing support structures for one or more containers, with the overall outline shown in a dot-and-dash line;

FIG. 10 is a view in cross section illustrating the longitudinal movement/support means, with the overall outline shown in a dot-and-dash line;

FIG. 11 is a view in cross section illustrating an example embodiment with a flat bed;

FIG. 12 is a diagrammatic perspective view of the carrier structure seen from one of its ends in its flat-bed version;

FIGS. 13 to 16 are successive views from the side, and then in plan, showing the loading/unloading by lifting;

FIGS. 17 to 22 are diagrammatic side views illustrating an unloading sequence in the in-line mode;

FIGS. 23 to 28 are views from the side and then in plan showing the various stages of a loading sequence in the oblique mode.

Figure 29:
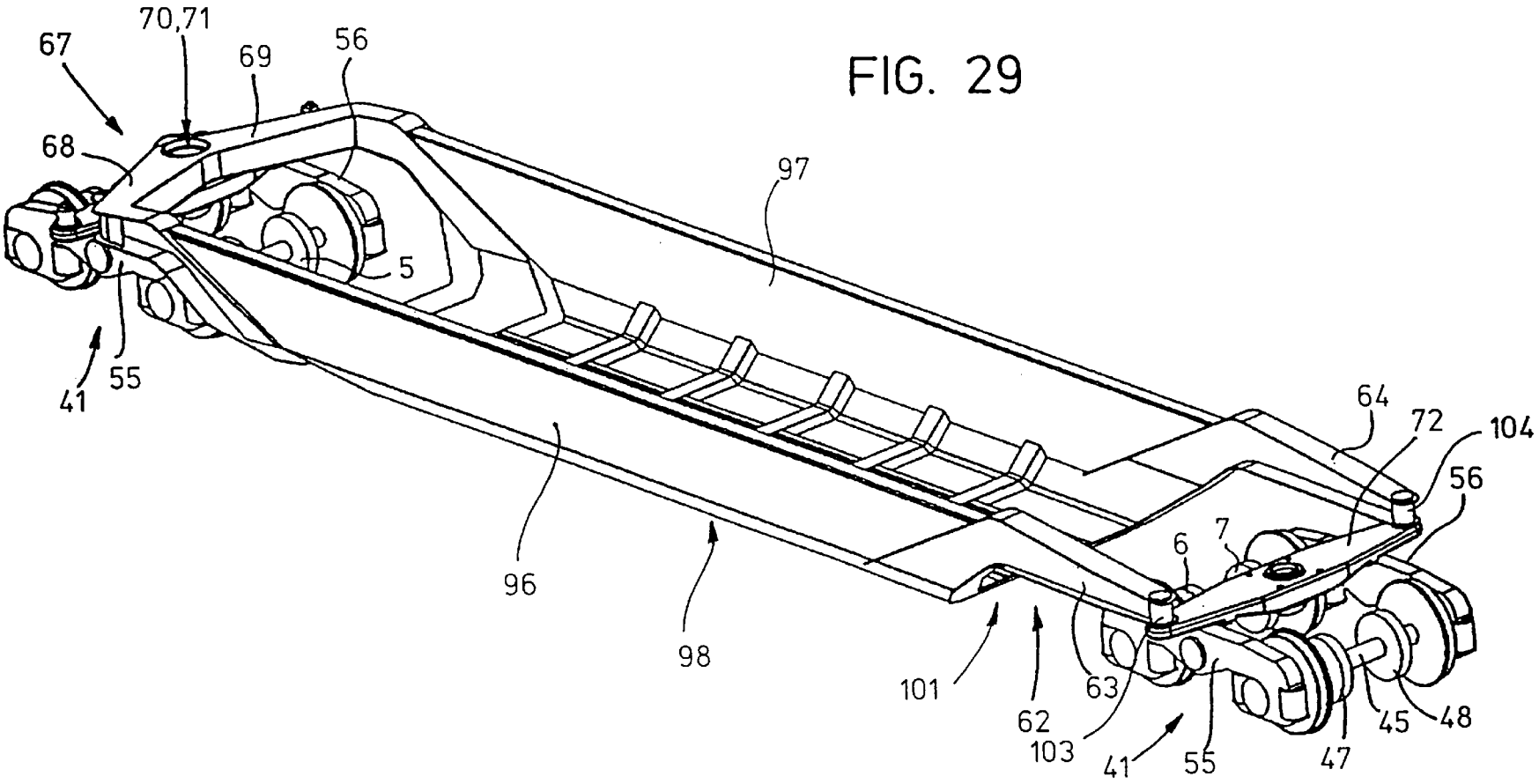
Figure 30:
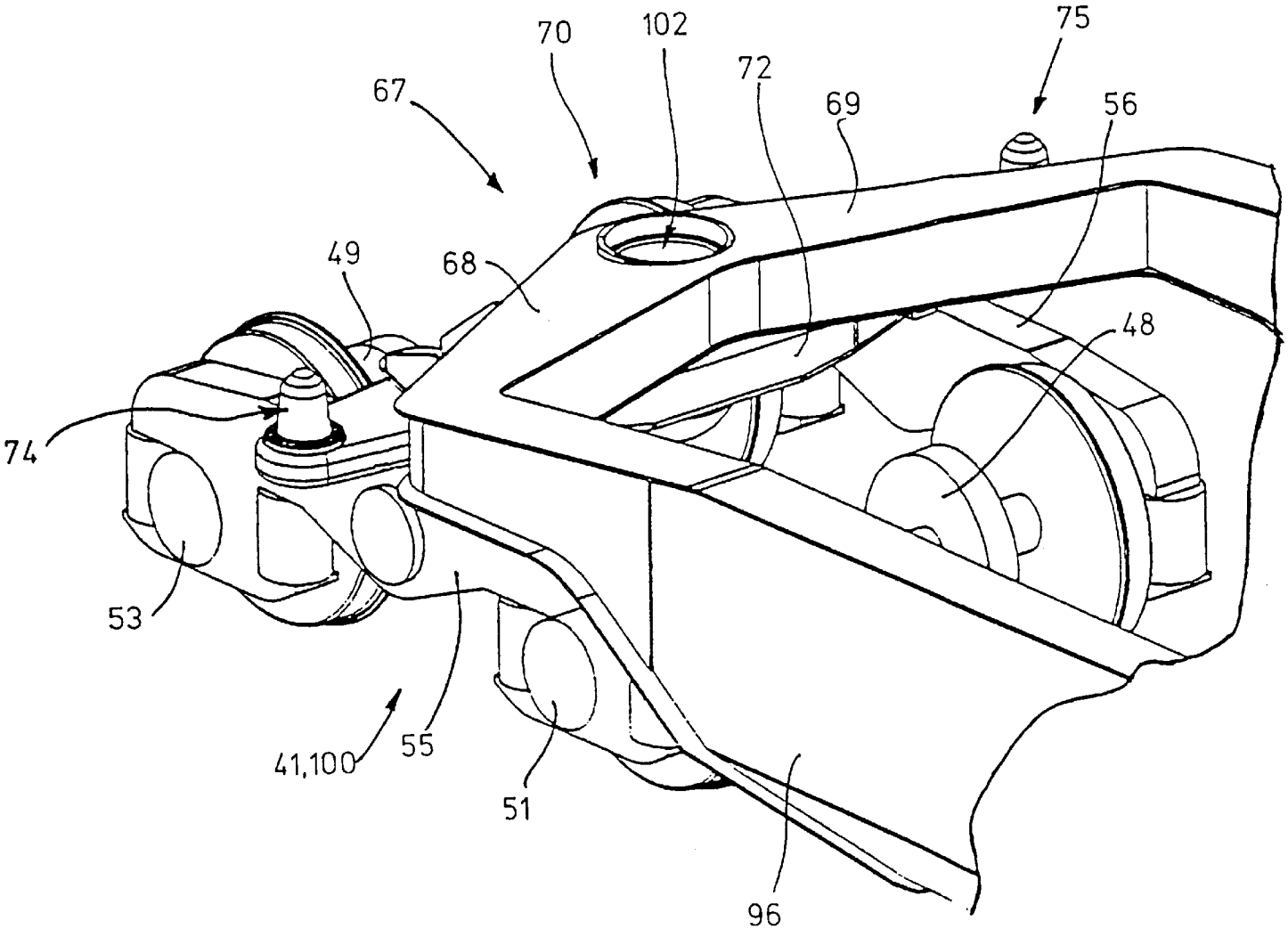
Figure 31:
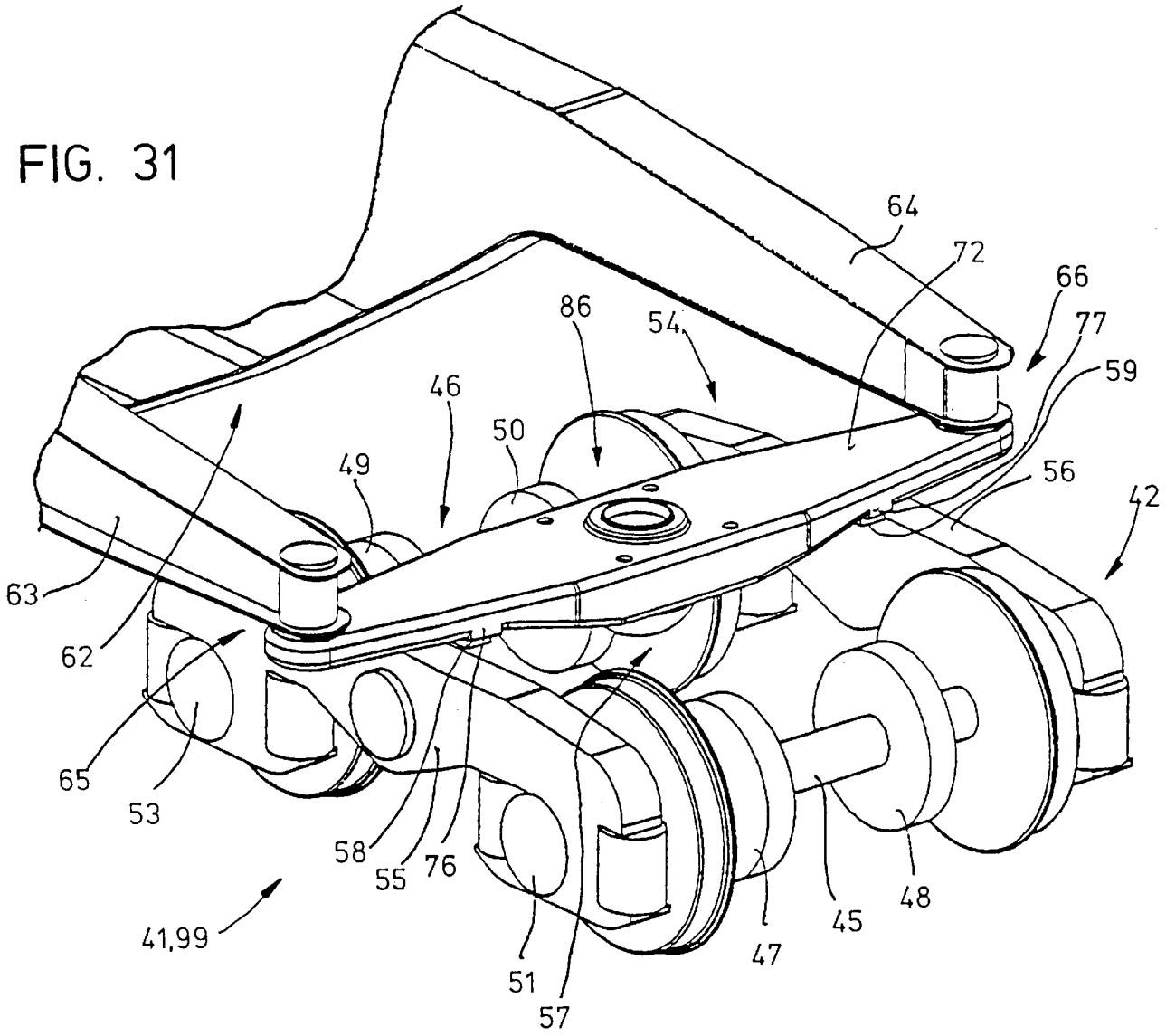
Figure 32:
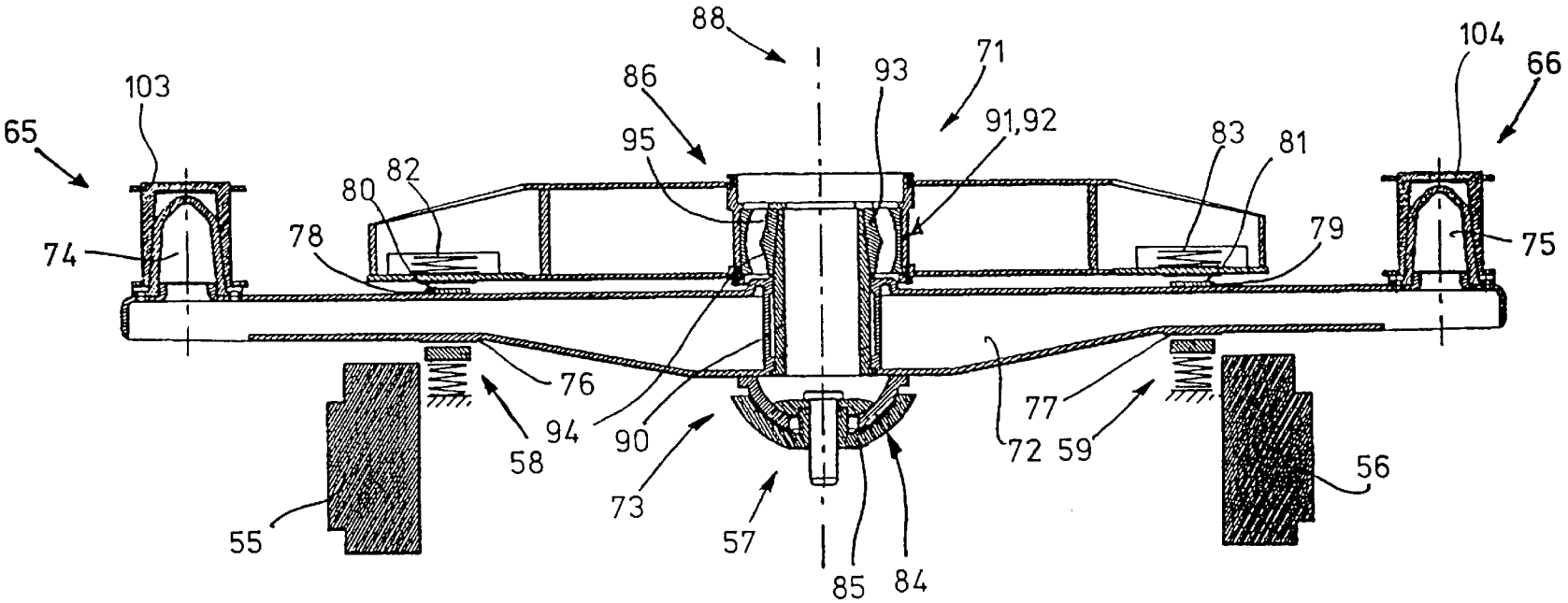
Figure 33:
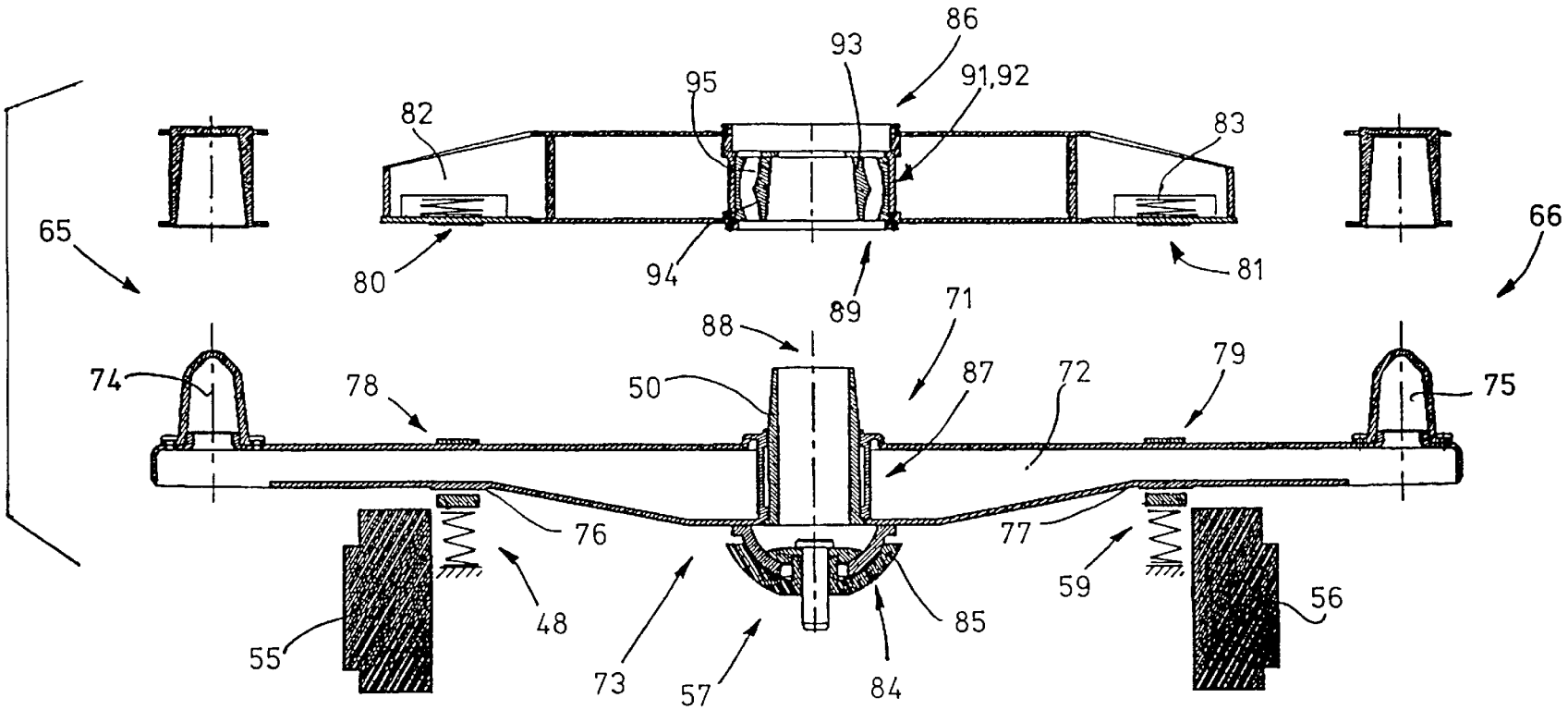
Figure 34:
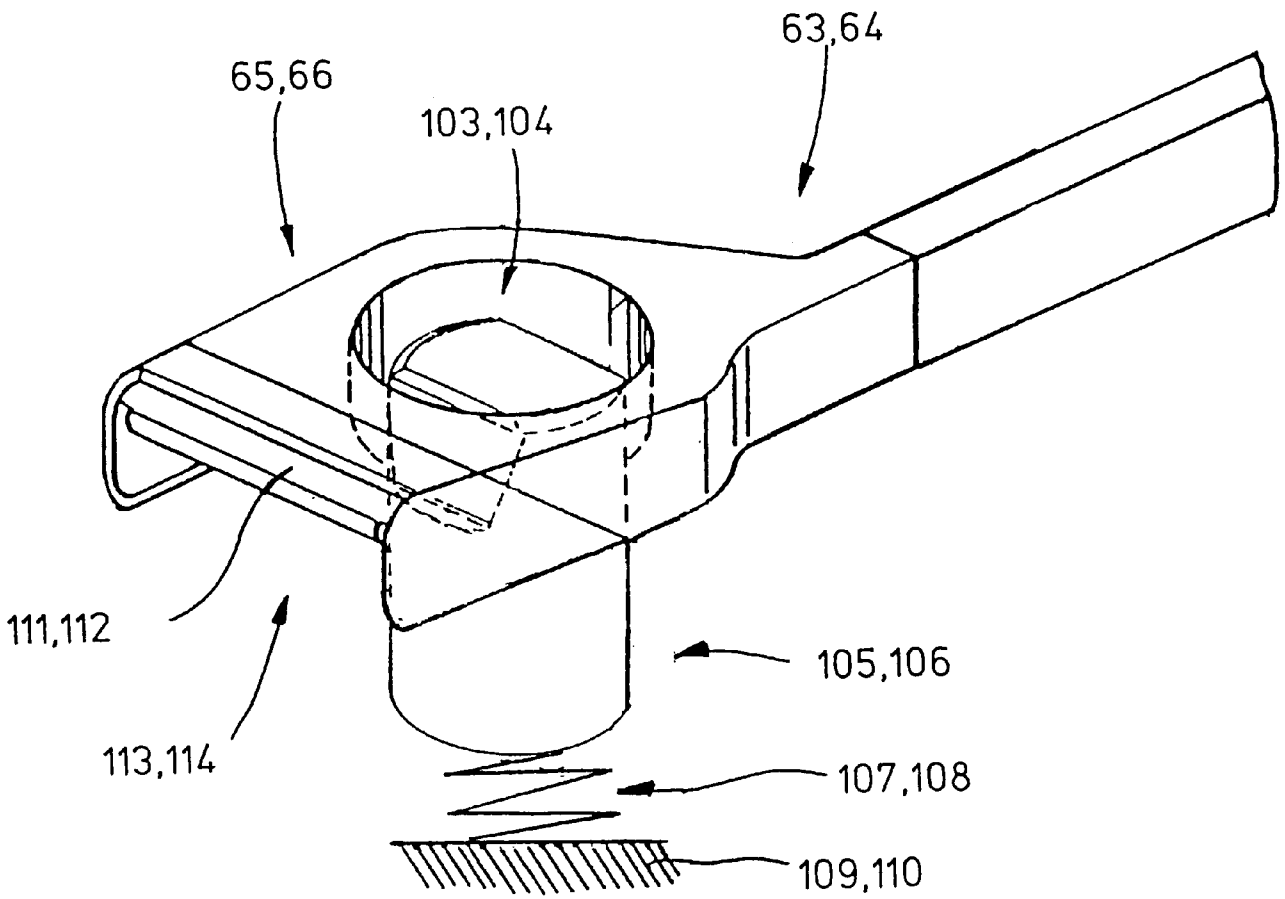
Figure 35:
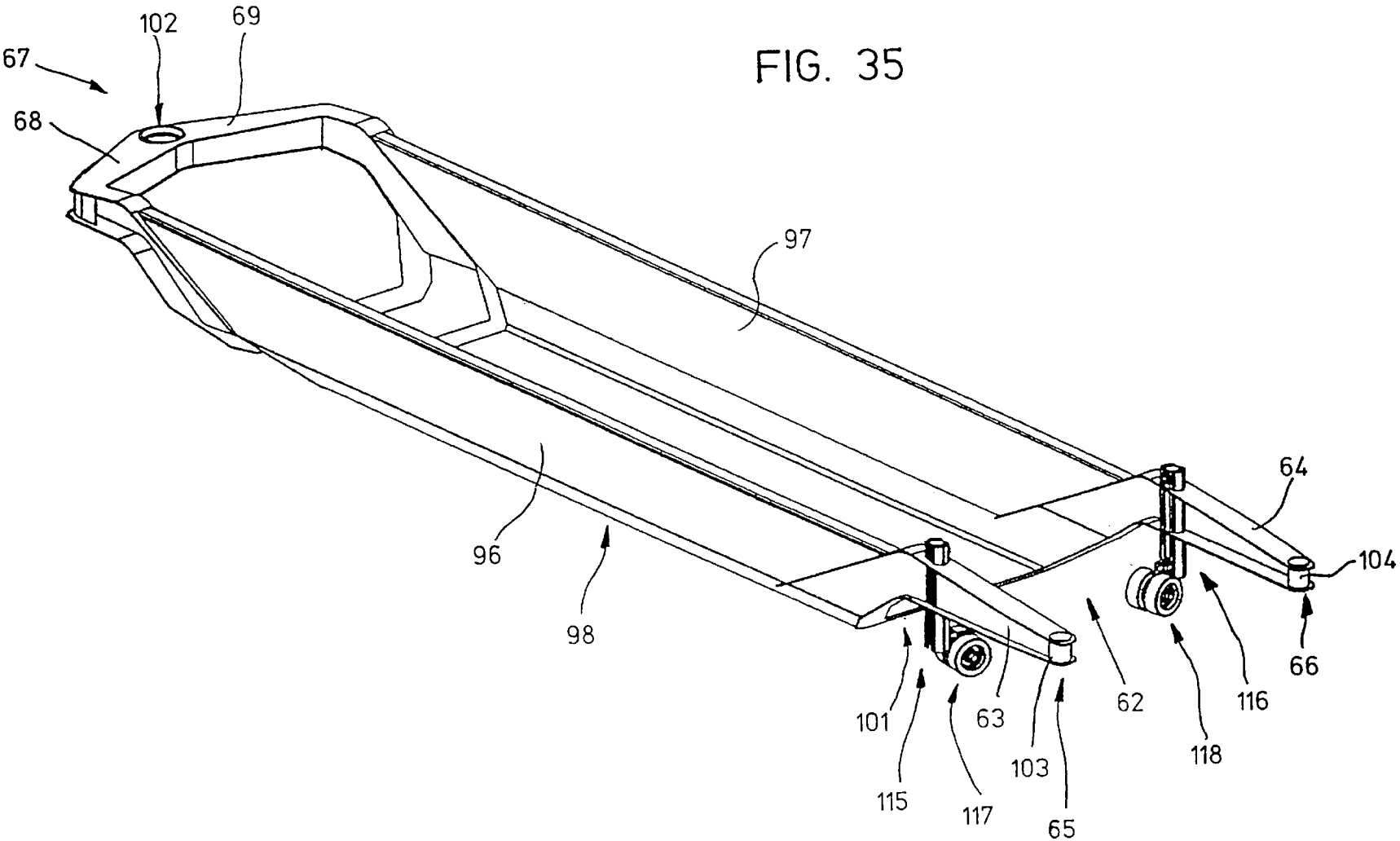
Figure 36:
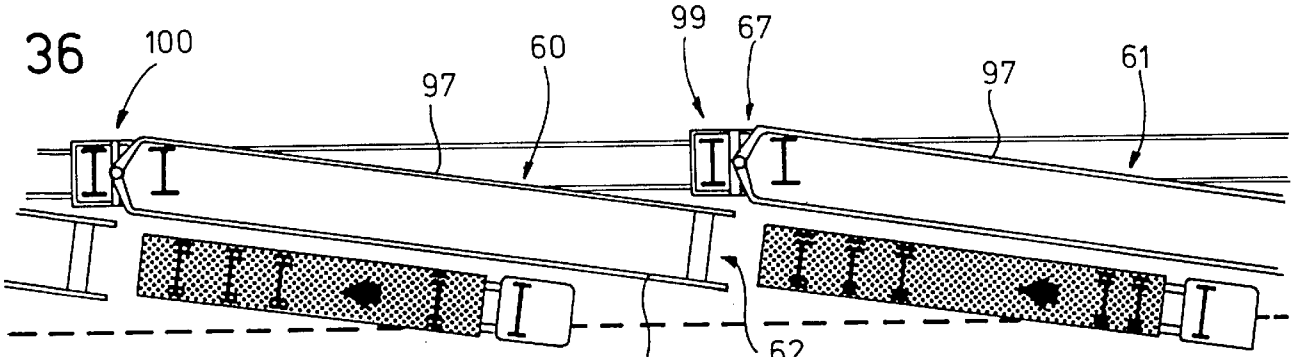
Figure 37:
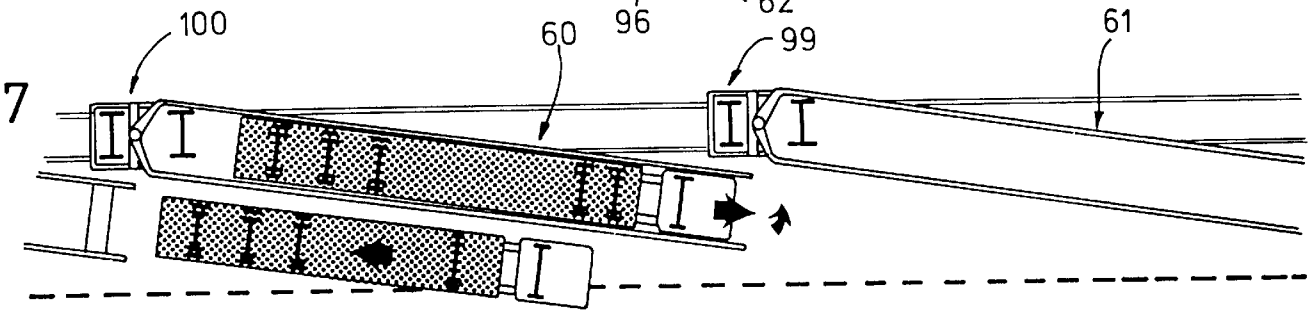
Figure 38:
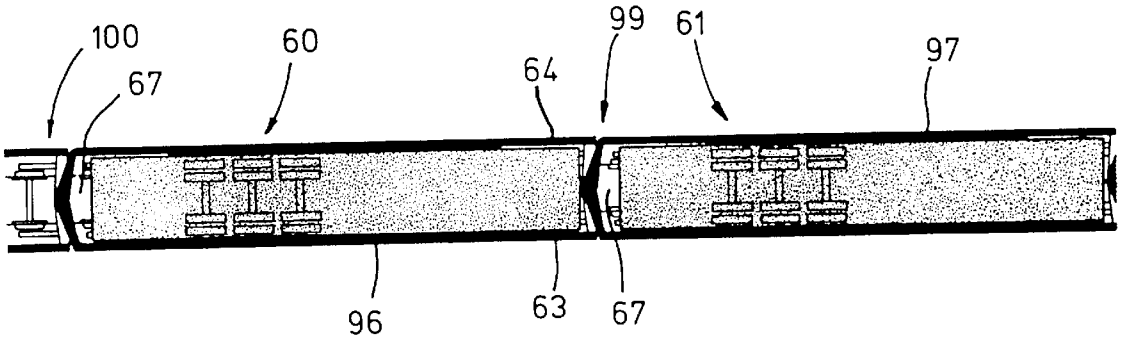
Figure 39:
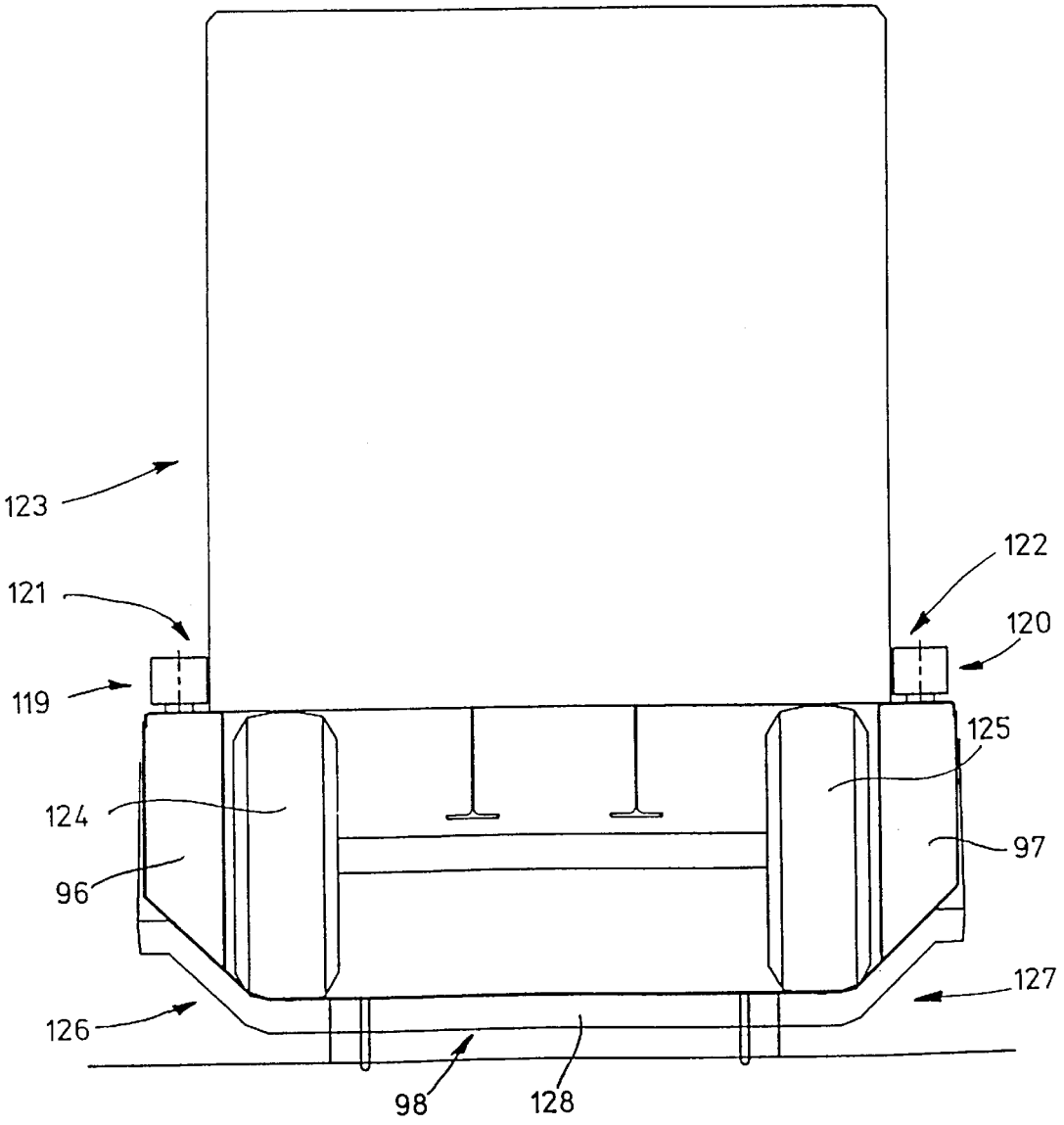

FIG. 29 is a general perspective view of the whole of the freight car structure according to the invention;

FIG. 30 is a perspective view of the front end and of the bogie interface on which it is mounted;

FIG. 31 is a perspective view of the front end and of the bogie interface on which it is intended to be mounted;

FIGS. 32 and 33 are views in longitudinal section of the cross-member before and after separation;

FIG. 34 is a perspective view of the end of one of the rear arms cooperating with a retractable pin;

FIG. 35 is a simplified perspective view of the freight car structure showing the integral vertical lifting and lateral travel means;

FIGS. 36, 37 and 38 are diagrammatic plan views illustrating loading at an angle in the case of an application to a road unit of the semi-trailer type;

FIG. 39 is a simplified elevation view of the rear of the freight car structure with a semi-trailer loaded on it.

Figure 40:
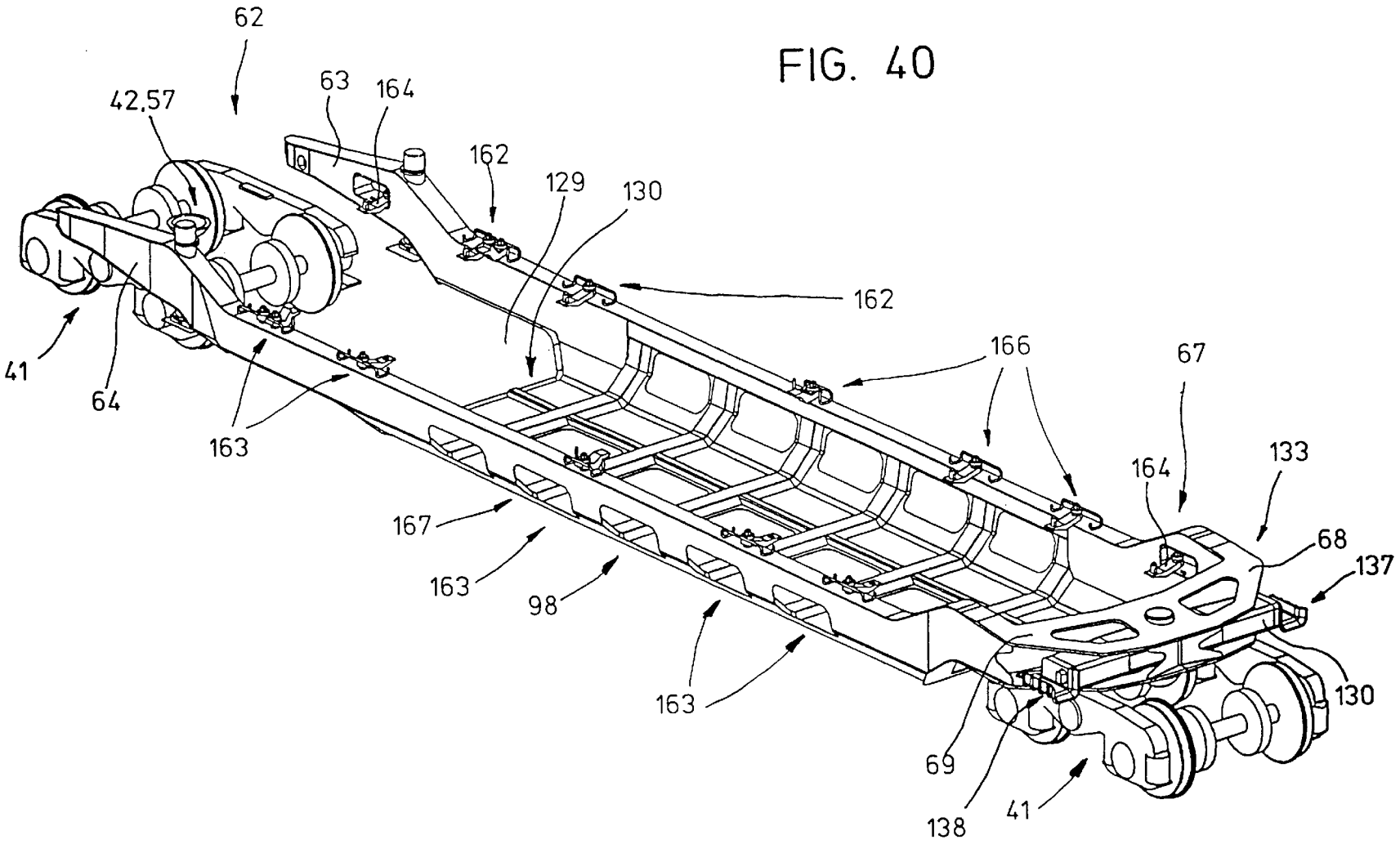
Figure 41:
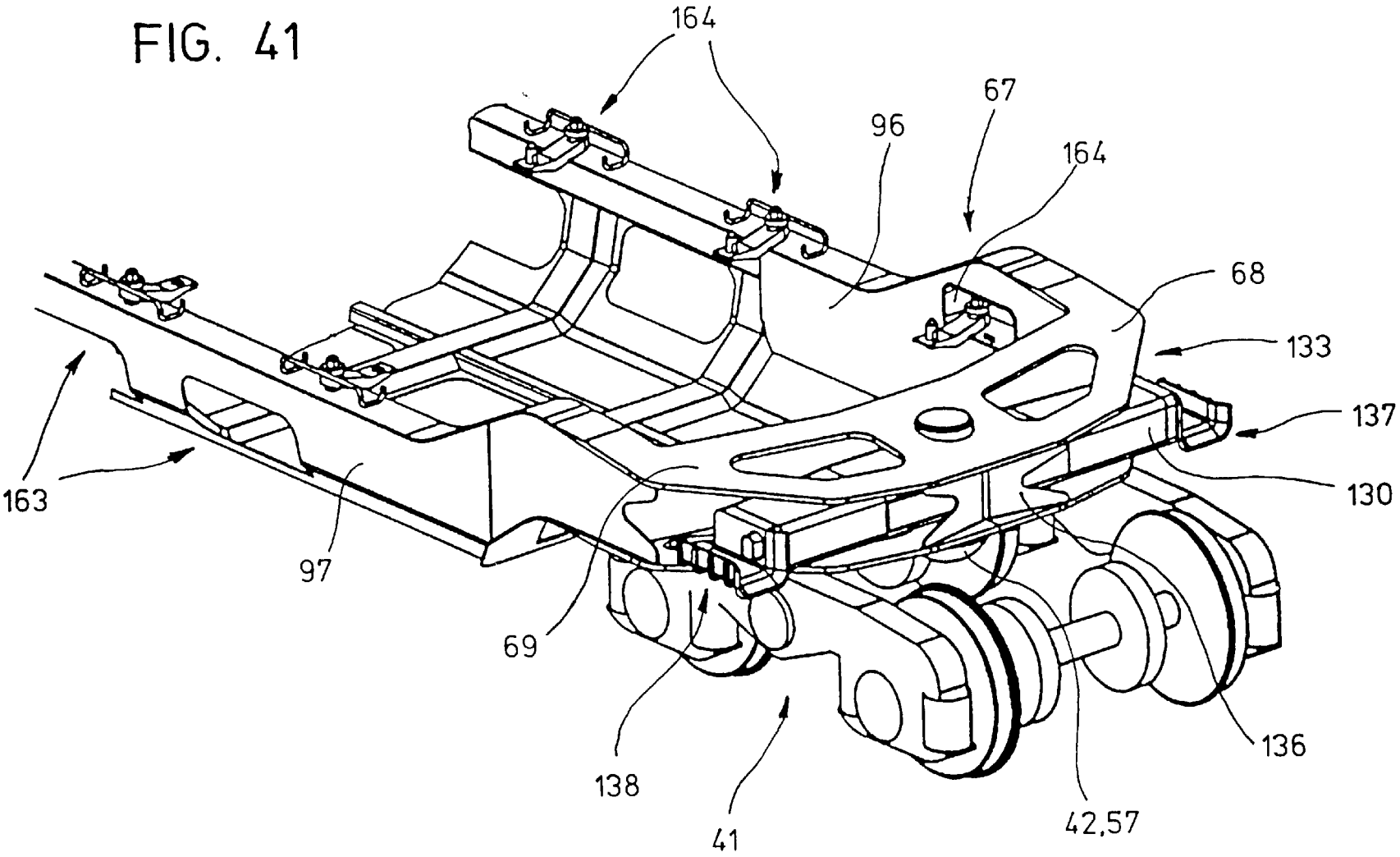
Figure 42:
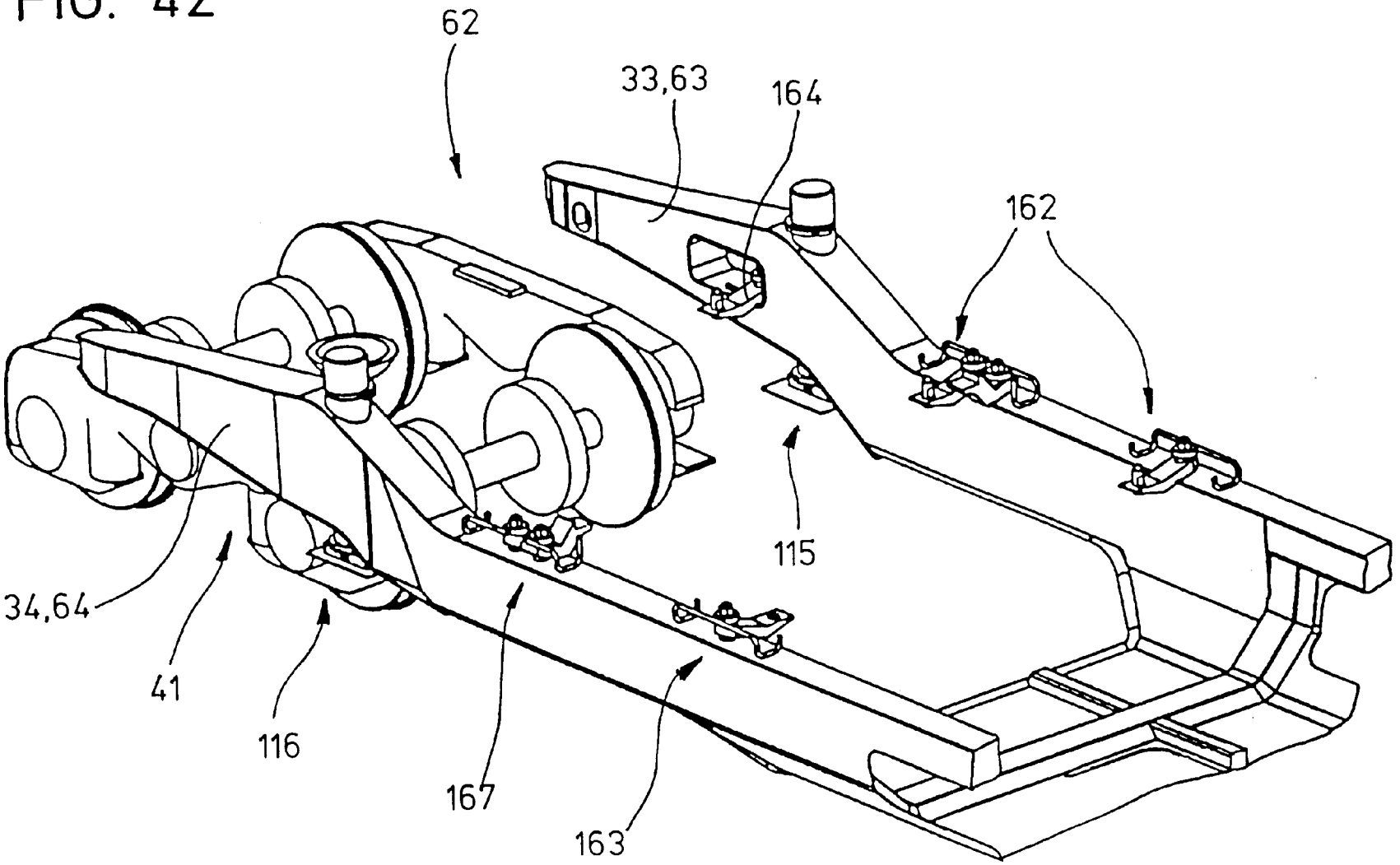
Figure 43:
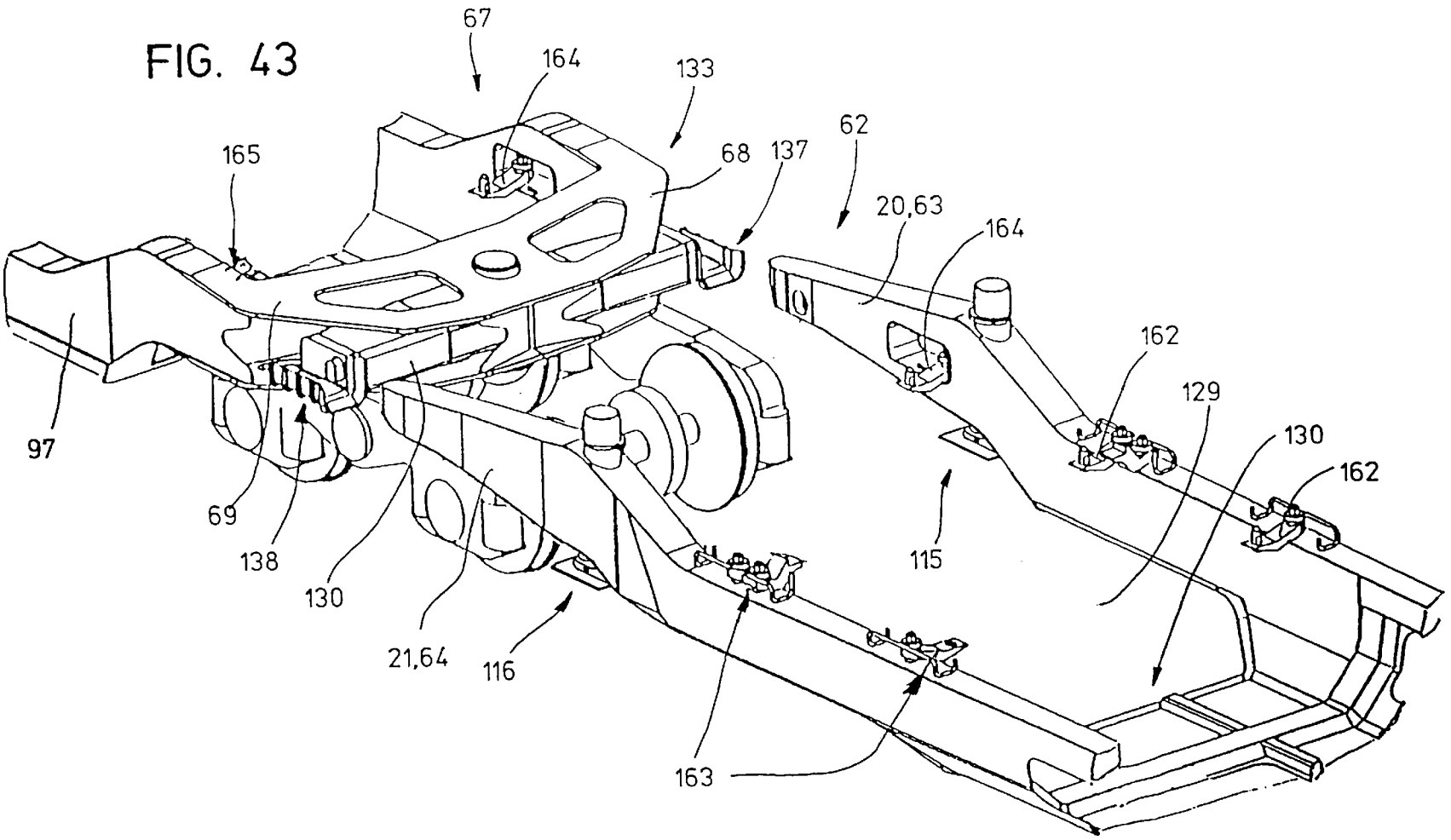
Figure 44:
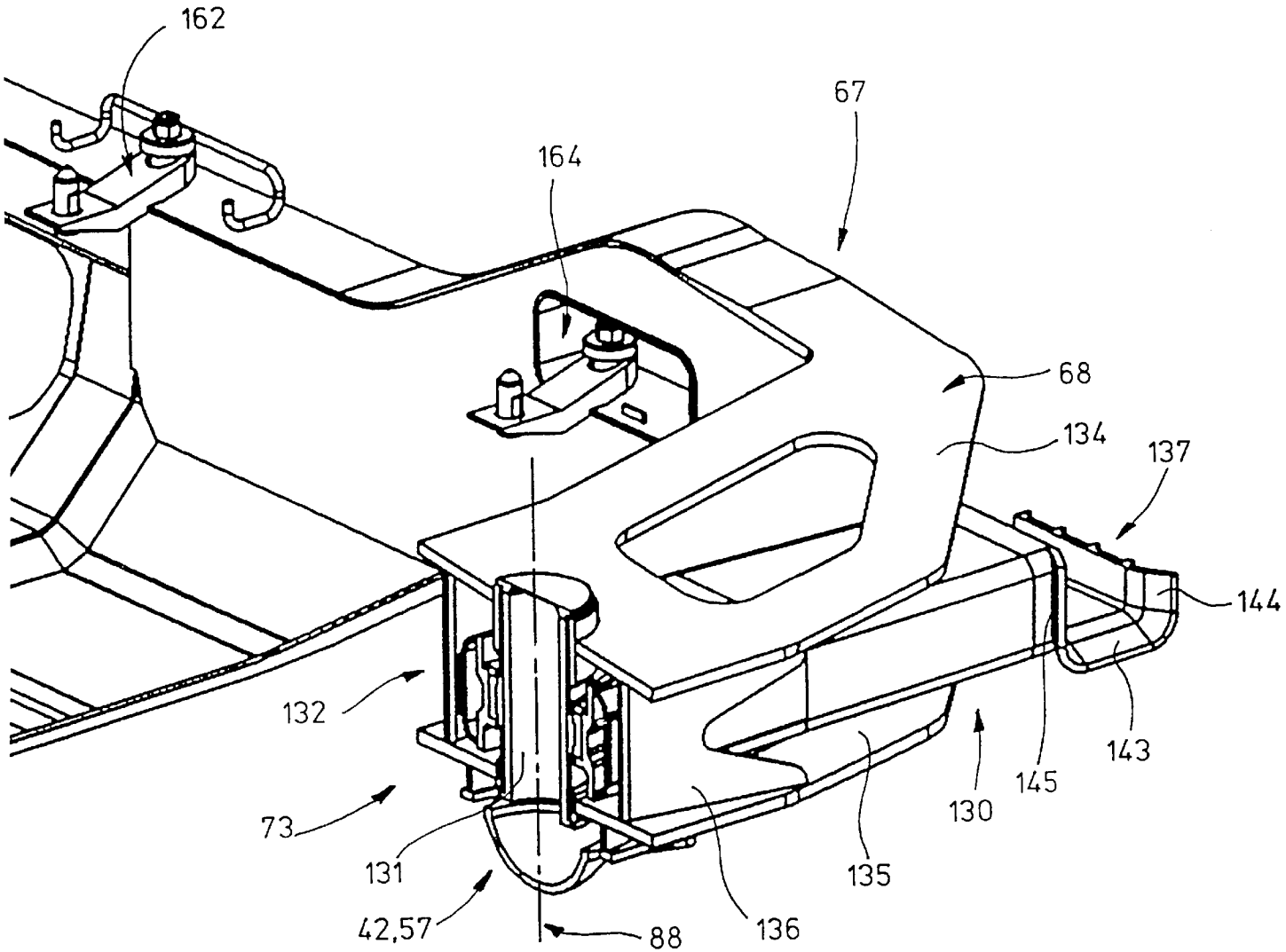
Figure 45:
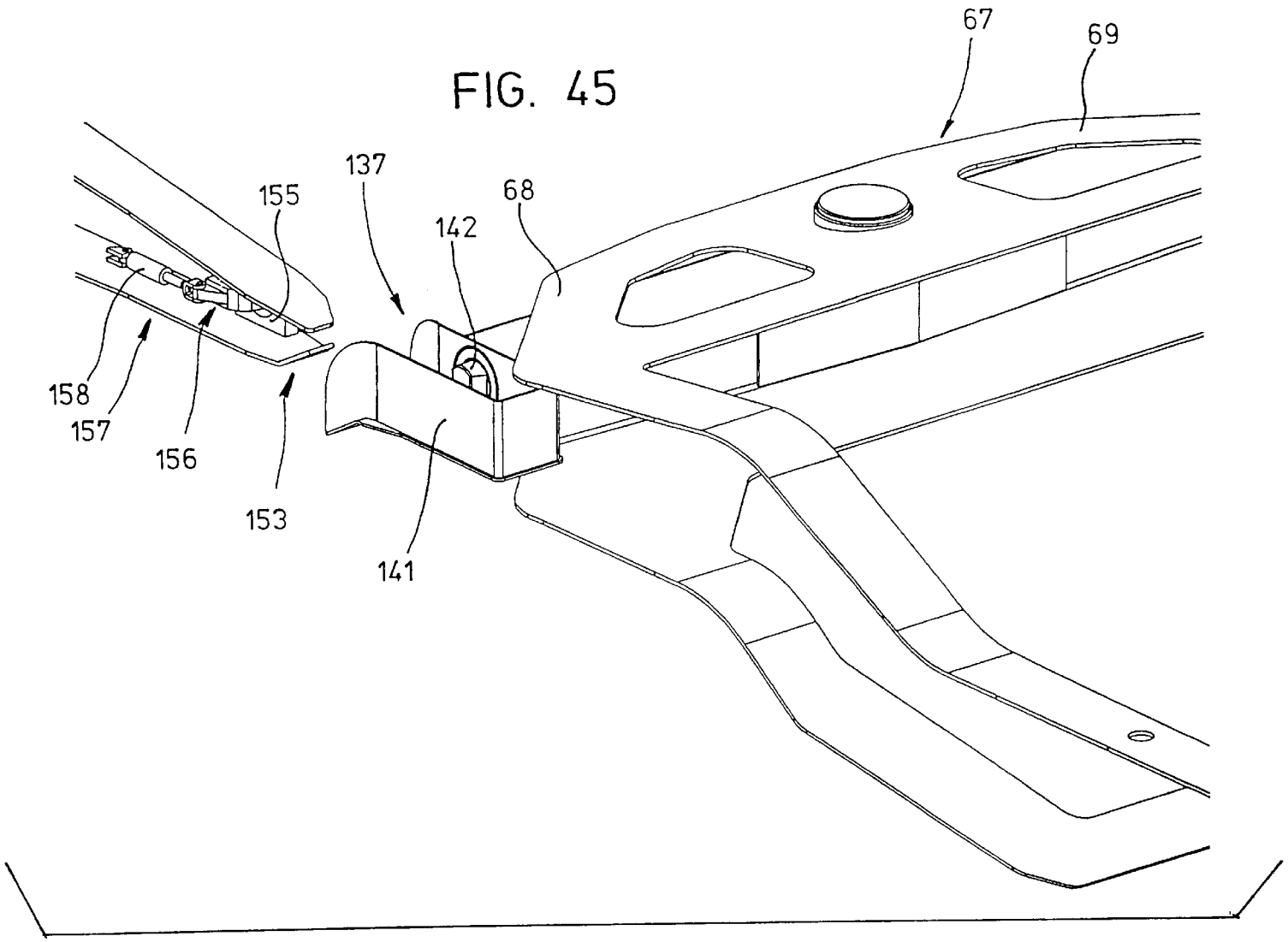
Figure 46:
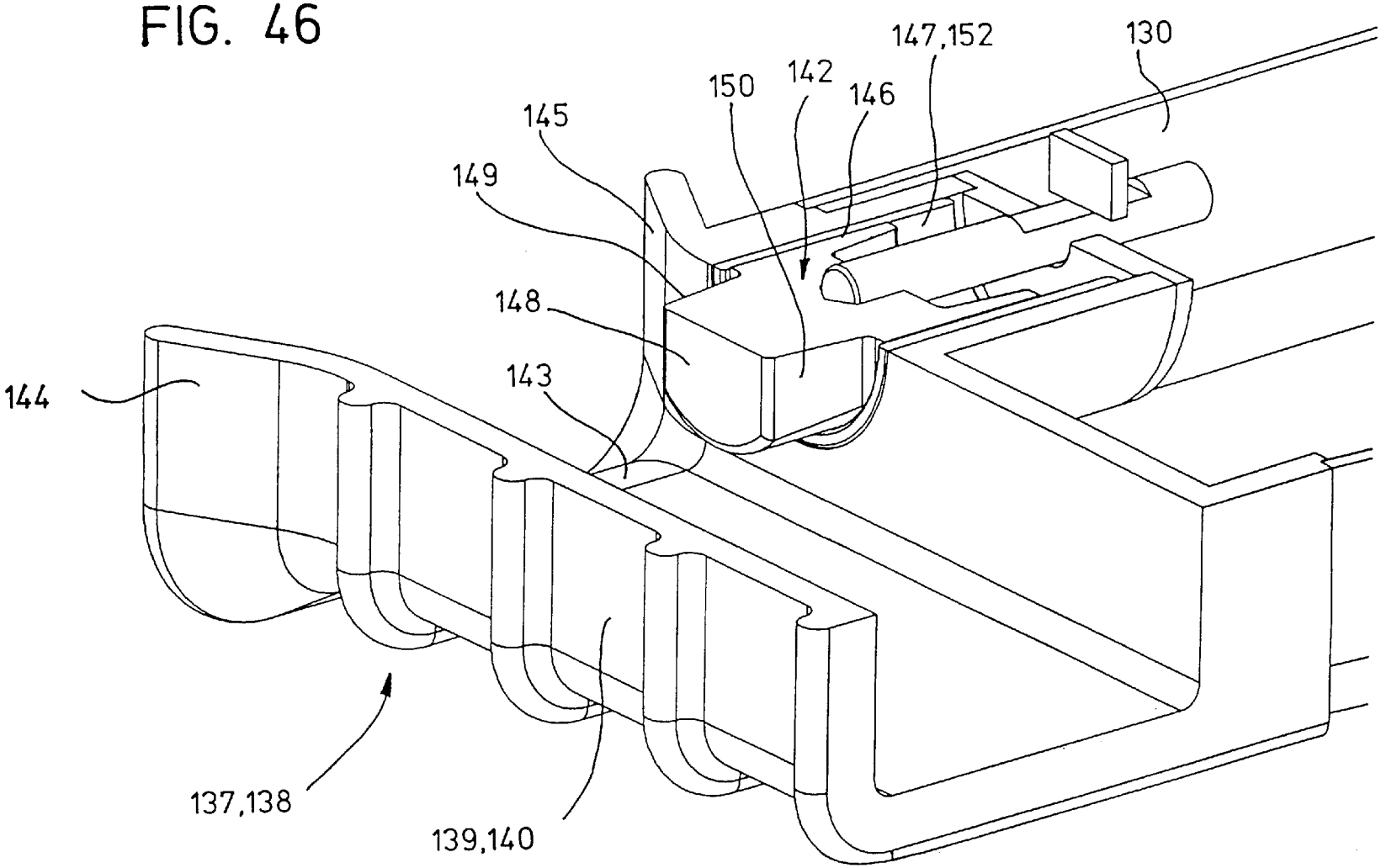
Figure 47:
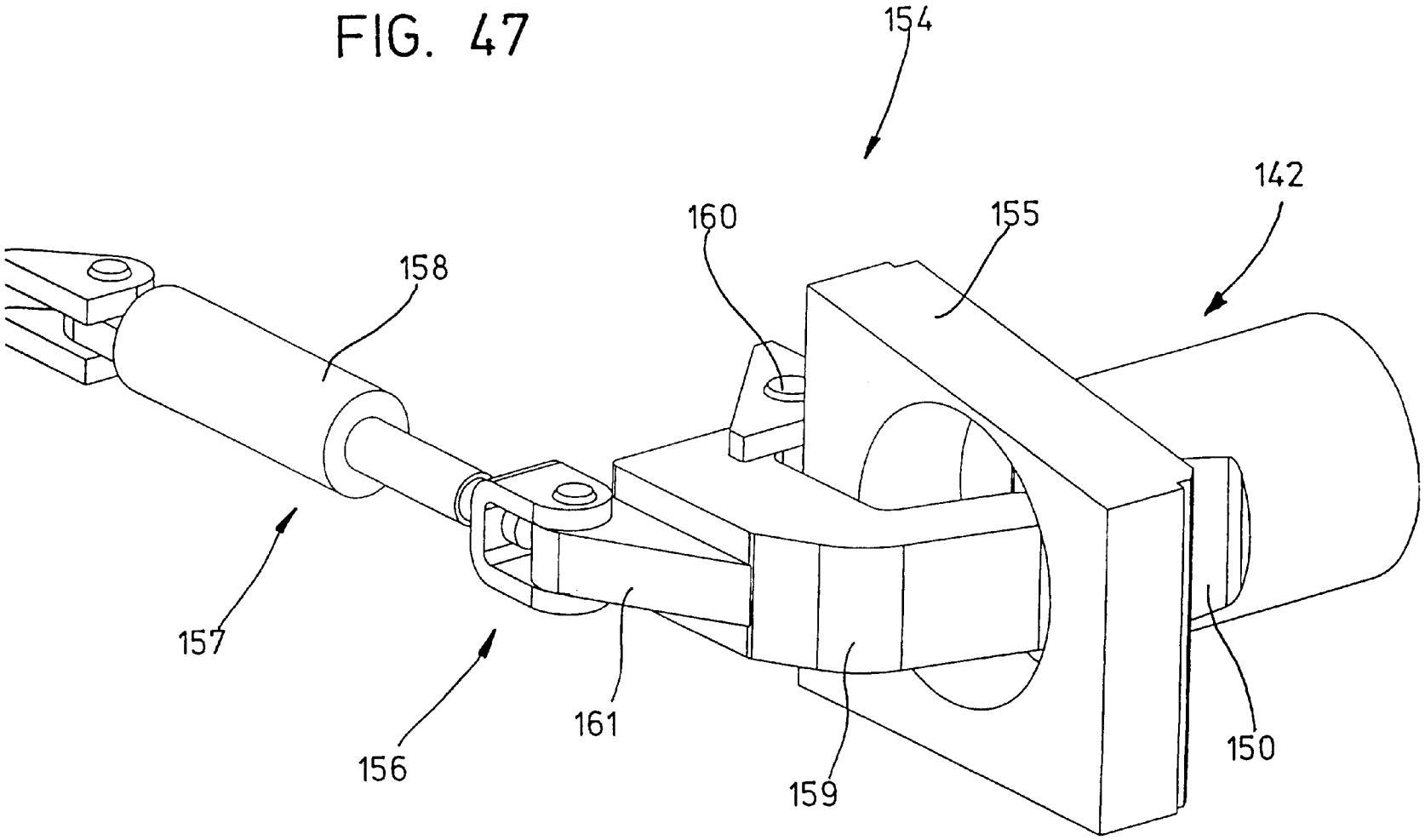

FIG. 40 is a general perspective view of the improved freight car structure in the reverse position showing at its front end the coupling assembly according to the invention;

FIG. 41 is a perspective view of the front end and of the bogie interface on which it is mounted;

FIG. 42 is a perspective view of the front end and of the bogie on which it is intended to be mounted;

FIG. 43 is a perspective view of the two opposite ends of two successive freight car structures before being connected together;

FIG. 44 is a detailed perspective view of one of the arms and of the rear end cut off at the common articulated unit;

FIG. 45 is a diagrammatic perspective view of the joining and receiving means, seen from only one side of two successive structures;

FIG. 46 is a perspective view, in partial section, of a support for receiving the pivoting cross-member, showing a retractable immobilising pin;

FIG. 47 is a perspective view of the joining means formed by the release mechanism and a receiving piece.

To make the description clearer and remove all ambiguity, the definition of the term "axle unit" in comparison with the term "bogie" is elucidated below.

In what follows, an axle unit or bogie must be considered to be any travelling railroad support, that is to say an assembly travelling on a railroad, formed by at least one axle and a minimum mechanical carrier structure including the bearings. In the case of a unit with two axles, this structure includes the mechanical chassis connecting the two axles.

In what follows, the concept of bogie must be understood as a more complete travelling railroad unit. It is formed by an axle unit and various intermediate mechanical means providing the connection between the freight car chassis and the said axle unit.

The intermediate mechanical means are referred to as "interfaces".

First of all, the railroad unit according to the invention will be described in general terms.

The rail transport unit according to the invention is composed of a connecting carrier structure 1 having front 2 and rear 3 longitudinal ends by which it is mounted so as to be directly or indirectly articulated on two railroad axle units, respectively front 4 and rear 5, by means of a suitable front 6 and rear 7 composite interface.

The carrier structure 1 has at least two parallel side-pieces 8 and 9 ending at the longitudinal front 2 and rear 3 ends, which may be separate or connected to each other.

According to a main variant, the composite interface 6 or 7 is integral with the corresponding axle unit 4 or 5.

To meet the general haulage requirements, there must be, between each axle unit 4 or 5 and the corresponding ends of the connecting carrier structure, at least one haulage articulation 10.

The composite end interfaces 6 or 7 have, separately or together, at one of their ends, buffers such as 11 and a coupling hook for damping shocks and transmitting the tractive force to the axle unit or bogie(s).

The carrier structure 1 is clear at least one of its longitudinal ends, for example the rear end 3, defining an access opening 13 which may be partial or complete but which is sufficient to enable the road-going cargo or load to pass through in the case of loading by means of longitudinal entry or in oblique mode.

To this end, at least the rear longitudinal end 3, which is clear at the opening 13, is mounted so as to be separable from the adjacent axle unit, at the front interface 6, by coupling/locking means.

There may be such coupling/locking means on the other front composite interface 7.

There may also be other specific coupling/locking means as an alternative on the front composite interface 7.

To implement the so-called oblique method of loading, at least one of the composite interfaces, preferably the front composite interface 7, will have a loading/unloading pivoting articulation 14 enabling it to be pivoted as a whole.

According to various variants, the two pivoting articulations, on the one hand for haulage 10 and on the other hand for loading/unloading 14, are juxtaposed or one and the same, or distinct but with identical axes.

The present invention covers both two single articulations and one double articulation pivoting in a common axis.

In order to allow several methods of loading/unloading, in particular loading/unloading by lifting, the connecting carrier structure can be disconnected from the two composite interfaces.

It may be disconnectable from the front composite interface by means of the loading/pivoting articulation 14.

Figure 1:
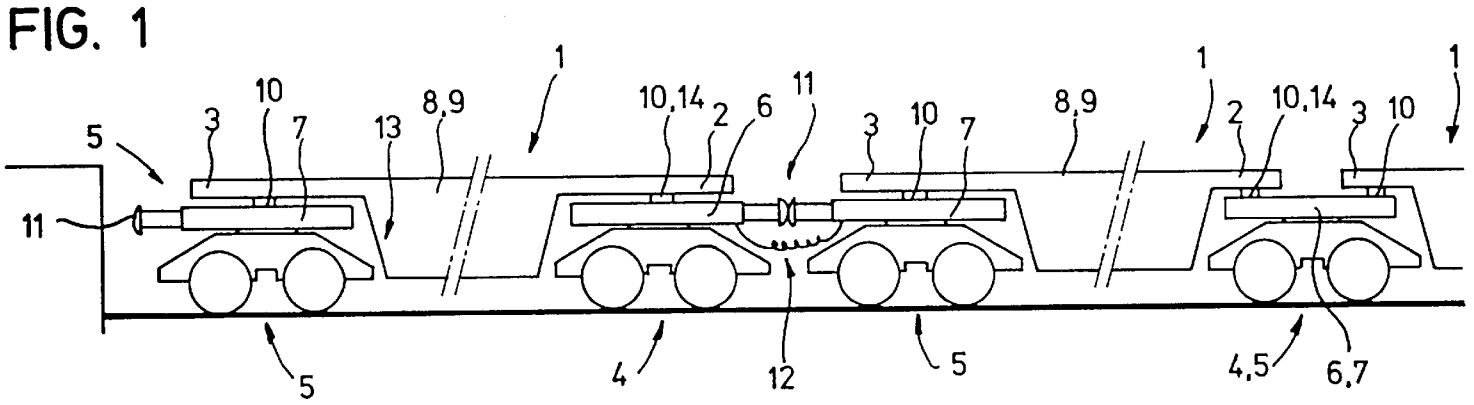
FIG. 1 is a diagrammatic side view of a composite succession of several rail transport units.
Figure 3:
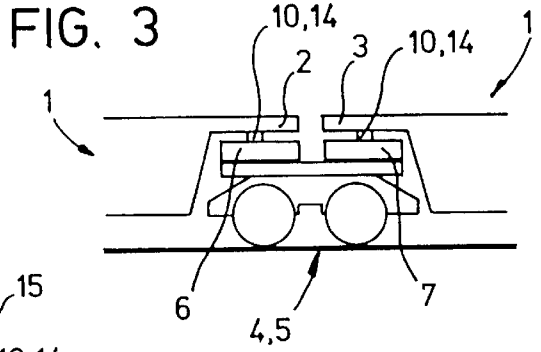
FIGS. 2, 3 and 4 are diagrammatic side views showing three types of ends of the railroad unit according to the invention, respectively.
Figure 2:
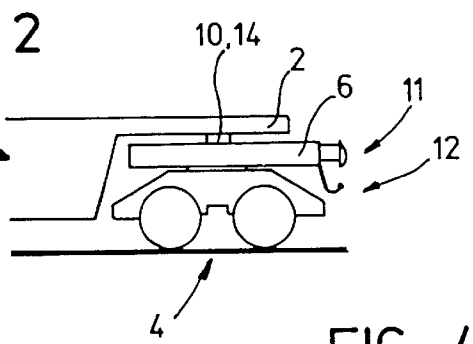
Figure 4:
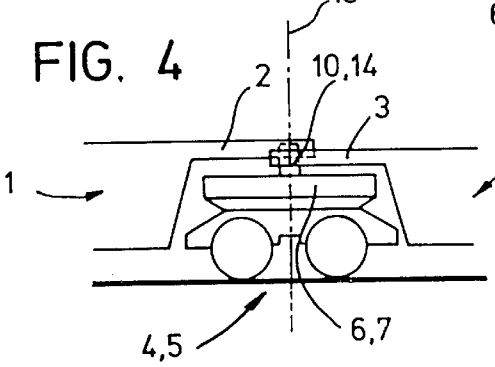

According to another variant shown in FIG. 4, the loading/pivoting articulation 14, which may be merged with the haulage articulation 10 of one end of the connecting carrier structure 1, is common with or has a common axis 15 with the loading/pivoting articulation of the end of the connecting carrier structure 1 which immediately follows it.

Concerning the method of loading/unloading by lifting, suitable components are provided at the connecting carrier structure 1, designed to cooperate with the conventional lifting means available in loading/unloading areas; goods stations, port areas, etc.

The integral lifting means 16 at either end or both ends enable a vertical disengagement movement to be produced which is sufficient to cause either end or both ends to become separated from the adjacent axle unit, or from its associated composite interface structure.

Lateral movement means, for example means of transverse travel 17 on the ground, optionally associated with the integral lifting means 16, have the purpose of enabling, in association with the lifting means, the connecting carrier structure to be uncoupled by a vertical, and then lateral, movement, for the purpose of bringing the transverse access opening 13 out of center and disengaging it completely from the corresponding composite interface (FIGS. 8 and 12).

The oblique and in-line loading/unloading methods are facilitated by means of the aforesaid characteristics, concerning the transverse access opening 13 at one of the ends, for example the rear end, the pivoting of the whole, and also the presence of linear carrier structures which will be discussed below.

The connecting carrier structure 1 is intended to carry various loads, in particular fully or partly assembled road-going loads.

This may, for example, as shown in FIGS. 5, 6 and 7, be an articulated vehicle-transporting road-going unit 18 transporting cars such as 19 or a semi-trailer 20, or again one or two containers or swap bodies 21 and 22 to ISO standards, fixed to their road-going base or supported in various ways, for example at their conventional corner fittings.

The road cargo is carried by various means.

A few particular means will be described below, by way of non-limitative example.

In general terms, these are internal linear carrier structures 23 and 24 which are present all along the side pieces 8 and 9 and which maintain the load support surface at a so-called sunken level, that is to say below the top level of the axle unit or bogie(s).

According to a first variant, these bottom carrier structures are produced in the form of means of movement along rolling, sliding or guiding tracks 25 and 26 for the wheels or running gear additional to the wheels (FIG. 10), or mobile transverse carrier structures receiving the wheels or sets of wheels of the road-going load to be transported. These may, for example, in the latter case, be carriages or cradles moving along the above tracks (not shown).

According to another variant embodiment, the connecting carrier structure has a bed 27, which may for example be flat, in the form of a plate 28 connecting the bottom edges of each of the side pieces 8 and 9 in order to form an access ramp and carrier surface for the road-going load (FIG. 11).

According to the above characteristics, the bed 27, also forming the access ramp, is the load-carrying surface and is situated at a so-called sunken level.

In addition, the rail transport unit may be open or covered and, in the latter case, have a fixed or removable cover.

In addition it will include support means, for example fixed or retractable top 29, 30 or lateral 31, 32 brackets equipped with rotary locking devices for supporting one or two containers or swap bodies by their corner fittings, these being able to be loaded or unloaded by a vertical placement or removal movement (FIG. 9).

According to another embodiment, the two side pieces 8 and 9 of the connecting carrier structure 1 extend longitudinally beyond each of their ends by means of parallel extensions in the form of arms such as 33 and 34, which may for example be rectilinear, coming to bear on the corresponding composite interface mounted on its axle unit or bogie(s) (FIGS. 12 to 28).

A rear end can be seen, with the transverse access opening 13, shaped as indicated above, through which the load enters in longitudinal mode, and a front end mounted so as to pivot on the front axle unit 4 by means of the corresponding composite interface.

According to another variant, the ends of the front and rear side pieces are, for example, connected to each other by a front and rear connecting cross-member such as 35 and 36 (FIGS. 12 to 28).

As already indicated, they can also be joined at their lower part by a bed plate forming the floor, which can be used as an access and support ramp.

As has already been indicated, the side pieces 8 and 9 may each be equipped along their inner face with a rolling, sliding or guiding track, designed to serve as a movement support for the wheels of a vehicle, as an extension of the hub or as a carriage carrying a support receiving the wheels of the road unit to be transported.

The front end has in addition, at the rear ends of the side pieces, integral lifting means 16 in the form of extendable props 37, 38 with a bearing base plate (FIGS. 8 and 12).

The travel means consist of bottom rollers 39 and 40, shown diagrammatically in FIG. 12.

In this form, the rail transport unit according to the invention may be mounted by each of its ends on a bogie 41 of the universal type, conventionally comprising running gear, a carrier chassis and a center bearing 42 into which a pivoting support 43 common to each of the connecting cross-members 35 and 36, or two independent pivoting supports, will engage so as to rotate, the cross-members each carrying, at each of their ends, coupling means with a locking device which immobilises in two or three directions, cooperating with suitable means. These pivoting connecting cross-members are each designed to connect and support the ends of each of the arms at the sides of the front end, as shown in FIGS. 13 to 28.

A single pivot may be used to provide the haulage pivoting on the one hand and in addition the loading/unloading pivoting function of the immediately adjacent connecting carrier structure, in the case of articulations with an axis common with that of the bogie pivot.

The above variant with a single pivot will now be described in greater detail, with reference to FIGS. 29 to 39.

This variant is already shown diagrammatically in FIG. 4, showing a common axle unit with a common interface and a common pivot axis.

The aim of the following additional descriptive exposition is to illustrate this variant by means of an embodiment using particular articulation and coupling means.

The freight car structure is a carrier structure complying with railroad standards. It is designed to be coupled so as to be separable, by one or other of its ends, to a bogie interface common to two successive adjacent structures identical for all the bogies in the same train.

The bogie interface is identical for all the bogies in the same railroad train.

The invention relates, but non-limitatively, to the use of conventional universal bogies.

For reasons of clarity and adequacy of description, an example of the bogie interface means able to receive the freight car structure by its ends in a way that is separable will first be described below, non-limitatively and non-restrictively in its application.

With reference to FIGS. 30 and 31, the universal bogie 41 is traditionally composed of two axles 45 and 46 which carry, if required, brake discs, for example 47, 48, 49 and 50.

The ends of the axles are mounted in bearing housings 51, 52, 53 and 54 supporting pairing units 55 and 56 constituting, with various other mechanical components, a chassis, which is not shown in detail. This chassis supports at least one spherical bearing, conventionally referred to as a center bearing 57.

This spherical bearing commonly receives, so as to pivot, the end bottom structure of the freight car supported by the bogie.

For reasons of stability and deflection during tilting on a curve, there are, near the pairing units 55 and 56 between adjacent wheels, supplementary supports known as transoms 58 and 59, associated with a vertical-deflection suspension mounted, for example, on each of the axle pairing units.

For reasons of clarity in the drawing, only the main structures of the bogie have been shown. Thus certain mechanical connecting supports which exist cannot be seen.

This common bogie interface, adaptable to all current railroad rolling-stock bases known as bogies, makes it possible to articulate and connect simultaneously the front and rear ends of two successive freight car structures in accordance with the invention on and by a single bogie.

Thus two successive freight car structures are connected by a common interface to a single bogie.

This bogie interface is intended to serve as a joining piece common to two successive freight car structures 60 and 61 of the same type in accordance with the present invention (FIGS. 36 to 38), for example removable and disconnectable, comprising an open rear end 62 used to provide access for the autonomous load, for example the road-going unit. This rear end is bordered by two arms 63 and 64 similar to the arms 33 and 34, each ending with a joining means 65, 66. The freight car structure also has a V-shaped front end 67 with two arms 68 and 69 converging to an apex 70 which serves as a pivot center 71.

The bogie interface in question is in the form of a pivoting interface cross-member 72 mounted on the bogie 41, having an articulated central assembly 73 common to the two successive freight car structures 60 and 61.

This cross-member 72 has at each of its ends a support for receiving, for example, centering posts 74 and 75 or means that can be withdrawn or retracted, for example retractable pins which will be discussed subsequently, for example ones with a tapered shape, designed to receive, in such a way that they are separable, each of the arms 63 and 64 of the open rear end 62 of one of the freight car structures supported by the common bogie. These receiving supports are aligned with the center of the cross-member. Next to these posts, or associated or integrated with them, additional locking devices (not shown) are provided to ensure the security of the coupling.

These receiving supports constitute means of joining with complementary shapes provided at the ends 63 and 64 of the arms of the open rear end 62 of the freight car structure.

The interface cross-member 72 has, in addition, on its underside, symmetrically on both sides of each side of its central articulated assembly 73, a bearing area, for example in the form of attached plates 76, 77 opposite each of the transoms 58 and 59, these plates serving as a bearing and contact surface for the cross-member 72.

In addition, the interface cross-member 72 may have on its top face, on each side of its central part, two bearing/friction plates 78 and 79 for two facing shoes 80 and 81 mounted on springs 82 and 83 designed to make the bearing contact less abrupt during rolling movements and thereby ensure stability during rolling.

The interface cross-member 72 rests on the bogie, on the one hand at its center in an articulated manner, and on the other hand at the sides through its bearing areas on each of the transoms, thus offering deflections in the three degrees of freedom necessary between a freight car structure and a bogie.

The articulated central assembly 73 proves to be complex.

It has a bottom articulation 84, carrying the cross-member 72 mechanically, said bottom articulation consisting of the center bearing 57, that is to say a ball joint fitting into the housing of a semi-spherical lower body 85 on each bogie, said ball joint allowing deflections in all directions, that is in the three degrees of freedom necessary between a freight car structure and its bogie.

The articulated central unit 73 also has a top articulation 86 resting or mounted on a member or mechanical structure 87 fixed to the interface cross-member 72.

This top articulation 86 is coaxial with the bottom articulation 84. These two articulations therefore have the same geometric axis 88.

The top articulation 86 receives, separably or otherwise, the pivot center 71 of the pointed front end 70 of the freight car structure, constituting with the latter an articulation means.

It is important that the top articulation 86 should permit at least the pivoting movements in a horizontal plane intended in the loading/unloading method using lateral oblique offset.

Thus only the pivoting function is essential for the top articulation.

Compensation for the slight deflection caused by rolling and pitching movements can be provided either by the slight elastic deformation of the freight car structures in association with the additional suspension means (transoms and/or other means) or by a ball joint or elastic deformation function at the receiving supports or retractable pins, or again by a combination of the above means.

Of course, this ball joint function additional to the pivoting function may be fulfilled simultaneously at the top articulation 86 and in the mixed top articulation described below.

Different technical forms can thus be envisaged for this top articulation, the overall function of which is that of a pivot with, optionally, a complementary ball joint function allowing pivoting movements about the axis 88 common with that of the center bearing and, optionally, slight tilting deflections.

An embodiment of this type of mixed pivot/ball joint articulation will be described below by way of example, but there may be other equivalent embodiments.

According to a particular embodiment, the top articulation 86 is a ball joint bearing 89 mounted on a pivot cylinder 90 fixed to the central part of the cross-member and coaxial with the vertical pivot axis of the center bearing.

This ball joint bearing extends around the pivot cylinder 90 and inside a cylindrical housing 91 with a conical external lateral surface 92 fixed to or disconnectable from the pointed front end 67 of the freight car structure.

The invention does not particularly relate to the disconnection of the pointed front end 67 of the freight car structure from the bogie. However, provision is optionally made for it to be separated, with or without the housing 91 of the ball joint bearing.

To this end, the V-shaped apex 70 of the front end of the freight car structure is in the form of a simple bore passing through, which may be either cylindrical or conical, fitting onto the external wall of the housing 91 of the ball joint bearing.

To fulfil simultaneously the pivoting and ball joint functions, the example bearing in this case is a bearing of the ball joint type 93 on stepped rollers 94 and 95 disposed in a barrel shape giving it a biconical profile, as shown in FIGS. 32 and 33.

Other equivalent forms of this articulation prove to be possible.

Reversal of the articulated connections can also be envisaged.

In this configuration, the front end 67 of the freight car structure is mounted directly on the center bearing, while the interface cross-member 72 is articulated above on an extension, an axis passing through the end 67 or in any other way.

Of course, in accordance with the general spirit of the invention, the articulations remain superimposed and coaxial, that is to say the pivot axes in a vertical position are one and the same.

From the above account, it should be understood that the front end 67 of the freight car structure may be articulated either above the interface cross-member 72 or below it. Thus one of the variants concerns the position of the articulations with respect to the cross-member, which is the reverse of that shown in the figures.

The freight car structure which has already been described in general terms will now be described in greater detail.

It is composed of two side pieces 96 and 97, similar to the side pieces 8 and 9, connected to each other at their base by a sunken bed 98, at the open clear rear end 62 connecting the freight car structure to a downstream bogie 99 by means of the joining means 65 and 66, and at the front end 67, coupling the freight car structure to an upstream bogie 100 identical to the first by means of the articulation at a single position by means of the apex 70.

The side pieces 96 and 97 are extended towards the rear, at a higher level, by the two parallel arms 63 and 64, like carriage shafts, defining, with the adjacent edges of the side pieces and the transverse end of the bed, the access opening 62 for the load.

The general conformation of the rear end 62, which can be seen in the figures, is such that the opening plane 101 of the latter is amply recessed with respect to the ends of the arms 63 and 64.

The side pieces 96 and 97 are extended towards the front by the two converging arms 68 and 69 disposed at approximately the same higher level as the arms 63 and 64 of the rear end 62. They are in the overall shape of a "V", the apex of which points forwards in a median area determined by the general vertical mid-plane of the freight car structure and an upper horizontal plane which may be the one defined by the two top parallel edges of the side pieces 96 and 97.

The apex 70 forming the junction of the two converging arms 68 and 69 is shaped so as to have an opening, for example an end bore 102 intended to enable it to be mounted either separably or inseparably, but preferably inseparably, on the top part of the double articulation 73.

The arms 63 and 64 of the rear end 62 end in technical forms which fit onto the end structures of the bogie interface pivoting cross-member to form the joining means 65 and 66.

These are, for example, end cones or tapered bores 103 and 104 fitting onto the centering posts which the interface cross-member has at each end.

When the end cones are fitted and locked, the freight car structure has a rigid transverse mechanical end connection consisting of the bogie interface cross-member.

They may also be joining means with retractable pins such as 105, 106, each mounted, with elastic return by means of a spring such as 107, 108, on a mechanical base 109, 110, as shown diagrammatically in FIG. 34.

The retractable pins 105, 106, which are present at both ends of the bogie interface, are disposed so as to be aligned with the central articulation.

They are tapered in shape overall with, at their top part, engaging surfaces with slanting faces to allow their progressive retraction.

They cooperate with the end cones 103 and 104, each preceded, according to this variant, by a sloping ramp 111 and 112 with two successive insertion slopes at the entrance of an opening 113 and 114 for recessed withdrawal and protruding release during longitudinal engagement and disengagement movements of the ends of the arms 63 and 64.

This coupling connection may be locked by additional end locking devices (not shown).

In order to permit autonomous separation by lifting by one end or the other or both simultaneously, the freight car structure optionally has, near its ends, individual lifting means, optionally with travel, integral or otherwise, preferably autonomous, for example a prop 115, 116 similar to the props 37 and 38 at each end of each side piece 96 and 97 (FIG. 35), this being at only one end of the freight car structure or at both ends at once.

The type of prop referred to is a retractable and extendable prop, for example one that is telescopic, manual or hydraulic.

In order to enable the freight car structure of the train to move in a transverse, oblique movement, in a completely autonomous manner, the base of each prop 115 and 116 is equipped with travel means, such as 117 and 118, with a directional or fixed axis.

In the case of a fixed axis, the constant general direction of this axis is radial, that is to say passing through the pivot center 71.

Separate travel means can also be provided for the props.

In order to facilitate the loading/unloading operations, initial guiding means are provided above the side pieces 96 and 97, at the level of the rear end arms.

These are for example rollers such as 119 and 120 with a vertical axis, intended to ensure the centering and then the guiding of the load along its sides, for example along the bottom edges 121, 122 of the body of a semi-trailer 123 (FIG. 39).

In the case of a semi-trailer, the centering is improved by the particular shape of the cross section of the sunken bed, for example the one shown in FIG. 39. The guiding of the tires 124 and 125 by the concavity and then the upward slope of the raised longitudinal edges 126 and 127 of the sunken bed 98, defining a longitudinal central support surface 128 with a width substantially equal to the track width of the semi-trailer, can be clearly seen in this figure.

In addition, integral stowage means are provided for the load, whether a semi-trailer, container, swap-body etc, for example bearing on the arms or the top or side edges of the side pieces.

Fixing is effected by conventional means, for example by rotary locking devices which may be standardised or otherwise.

The joining and separation of the successive freight car structures with the single bogie interface are effected by the connection or disconnection of the joining means at the rear and, if applicable, of the articulation means at the front.

Movements, for example vertical movements, are sufficient to engage or mount the components of the articulation means at the front or of the joining means at the rear in each other or on each other on the same bogie interface.

Thus the tapered bores 103 and 104 on the ends of the arms 63 and 64 of the rear end 62 of the freight car structure fit onto the end centering posts of the interface cross-member 72 with the closure of the additional locking devices, or are disconnected from the latter by simple vertical movements or without needing any lifting at all in the case of retractable pins.

Similarly, the front end of the freight car structure carrying the ball joint bearing is mounted on the pivot cylinder 90 or separated from the latter in the case of a disconnectable variant according to which the front end tapered central opening or bore can equally well be mounted on the tapered bearing head or be extracted from the latter by simple vertical movements.

In FIGS. 40 to 47 a further variant embodiment of a coupling assembly has been shown, according to which the pivoting cross member is integral with the V-shaped front end 67 of the freight car structure.

In addition, according to this variant, the means of locking the connection with the adjacent freight car structure is composed of a retractable transverse pin provided at each end of the pivoting cross-member and of a receiving and extraction mechanism at each end of the shaft arms of the adjacent freight car structure.

This variant, as will be seen below, permits a simpler and faster coupling maneuver. This is because the need to prearrange the connecting members or mechanical pieces ready for coupling has been completely eliminated.

For reasons of simplification, components which are identical or similar to those described for the previous version will bear the same reference numerals.

Two successive freight car structures are connected by means of a common interface of a single bogie. This interface can be seen particularly in FIGS. 41 to 45.

It serves as a connecting piece for two successive removable and disconnectable freight car structures, the rear end 62 of which is open in a deep cut-out 129 in the longitudinal direction of the sunken bed 98, producing an open space of considerable size.

This open space results from moving forwards the rear transverse edge 130 of the bed 98 of the freight car structure.

The two arms 20 and 21 or 63, 64, which border the rear end of the freight car structure, each end in a joining means with a transverse immobilising mechanism.

The V-shaped front end 67, with two arms 68 and 69, is mounted so as to pivot by its apex on the articulated central assembly 73, which is a pivoting assembly with a geometric axis 88 in common with the pivot axis of the pivoting cross-member and that of the centre bearing 42, 57 when it is in its vertical position.

The articulated assembly 73 provides the pivoting connection between the center bearing 57, a special pivoting cross-member 130 and the front end 67. It is similar to the one already described for the previous variant with centering posts because it also has, as is shown in FIG. 44, a pivot cylinder 131 around which is mounted an inner pivoting articulation 132 by which the cross-member 130 is articulated.

According to the present variant, the pivoting cross-member 130 is mechanically integrated in the front end 67, which is duplicated and marked 133, that is to say this front end is produced as two parallel plates 134 and 135 spaced apart and held separate from each other by a spacer 136 and the pivoting cross-member 130 is itself mounted so as to pivot on the articulated assembly 73 and is housed in the space between the two plates of the front end 133 (FIGS. 41 and 44).

The pivoting cross-member 130 therefore remains mechanically free, particularly where independent pivoting movements are concerned, but is sandwiched between the two plates 134 and 135 of the front end 67.

More precisely, according to the method of construction used for the basic variant, the two spaced-apart parallel plates 134 and 135 forming the V-shaped front end 133 are fixed to the pivot cylinder 131, which is itself fixed to the centre bearing 57 of the bogie. In addition, the pivoting cross-member 130 is mounted so as to pivot on the pivot cylinder 131 by means of the internal articulation 132.

Said internal articulation is preferably the simple bearing type or of the type of bearing with a ball joint effect in order to allow small tilting deflections such as those caused by rolling or pitching movements.

The pivoting cross-member 130 has at each end a receiving support 137 and 138 enabling the join between its ends and the ends of the arms 63, 64 of the pair of shafts next to it, that is to say the connection with the preceding or following adjacent freight car structure, to be established, maintained and separated.

Each receiving support is shaped like a cradle 139 and 140 or a folded sheet-metal housing such as 141 (FIG. 46), in each of which emerges a transverse immobilising pin such as 142 mounted so as to move transversely and under an elastic restoring force towards its protruding position. Each cradle or housing has, more precisely, the general shape of a channel with inclined bottom converging entry slopes 143 and lateral converging entry slopes 144 and 145.

These slopes, by virtue of the centering/guiding function which they provide, make it possible to engage and then position the ends of the arms, by the same movement, in the corresponding receiving support and to adjust the ends of these same arms slightly in height, in advance and automatically, so that they can be brought to the same level as the pivoting cross member, that is to say into the travel position.

Indeed, the raising or lowering of the open end of the freight car structure is provided by props 115, 116, preferably hydraulic, mounted on the arms of the pair of shafts.

In an elaborate version, the duplicated front end 133 is produced so as to be vertically separable from the articulated assembly 73.

In a simplified variant, the front end 133 is formed from a single plate above the pivoting cross-member and can therefore be separated vertically from the bogie. In this case the pivoting cross-member is completely independent because it is not sandwiched and the loading/unloading by vertical separation applies entirely.

The joining means provided at the end of each arm of the pair of shafts, intended to cooperate with receiving/immobilising means provided at each end of the pivoting cross-member with a view to establishing a separable connection, will now be examined more particularly with reference to FIGS. 45 to 47.

First of all, the receiving/immobilizing means consist of the receiving supports 137 and 138 and the transverse immobilizing pins such as 142, which are able to move transversely between a retracted position and a protruding position towards which they are pushed by a return spring.

Each immobilizing pin 142 may have a cylindrical body 146 sliding in a cylindrical housing 147 and a head 148 with two bevels 149 and 150, which are for example slightly at an angle, as shown in FIG. 46. In this figure a guide rod 151 can also be seen and a housing 152 in which a return spring (not shown) is mounted.

As for the joining means, these involve the converging shape such as 153 for engaging, with centering and guiding, the ends of each arm 63 and 64 of the pair of shafts: for example the shape shown in FIG. 45.

In each of these ends is housed an engagement/extraction mechanism such as 154, which can be seen in FIGS. 45 and 47.

It is composed of a receiving piece 155, in which is engaged the immobilising pin 142, and an extraction mechanism formed by a rocker 156 actuated by an articulated assembly 157 with an adjustable connecting rod 158 or equivalent means. The rocker comprises a pivoting angled disengaging piece 159 articulated on the one hand on a pivot 160 and on the other hand on the end of the connecting rod 158 by means of a lateral plate 161.

The fact that the end of the angled disengaging piece 159 bears on the head of the retractable immobilizing pin 142 makes it possible to extract the receiving piece 155 and release the corresponding end of the pair of shafts. Unlocking is thus ensured and can be controlled remotely.

By virtue of these automatic joining means and the receiving means with mechanical disengagement, during operations involving positioning prior to coupling, the multiple precentering adjustments necessary with devices having vertical centering posts, are avoided. This is because the height is adjusted automatically and the centering/guiding is ensured by the converging entry ramps provided at the ends of the receiving supports and at the tapering end of each arm.

In order to allow the pivoting and an initial height adjustment of either end, or both simultaneously, the freight car structure optionally includes, near to its ends, individual lifting means, optionally with travel means which may or may not be integral and are preferably autonomous, for example the props 115, 116 provided at each end of each side piece, at one end only of the freight car structure or at both ends simultaneously.

The lifting means enable the freight car structure to be coupled and uncoupled without any external handling means.

To allow the loading/unloading of containers, whether standardised or not, rotary locking devices such as 162 and 163, cooperating with the bottom corner fittings which the containers have for the purpose of fixing them to the freight car structure, are provided on the top face of each of the side pieces.

In order to accommodate containers of different sizes, four end rotary locking devices are provided, two, such as 164, at the front and two, such as 165, at the rear. These end rotary locking devices are supported by a retractable plate which makes it possible to withdraw the assembly inside the wall of each end of each side piece.

Other supports, such as 166 and 167, are provided on the top faces of the side pieces for supporting road-going vehicle bodies.

The loading/unloading stages are identical to those for the preceding variants, although this variant is more particularly oriented towards oblique or in-line loading/unloading.

This variant makes it possible to avoid the multiple precentering adjustments which are necessary with the version having vertical centering posts. This is because the height is adjusted automatically and the centering/guiding is provided by the entry ramps provided at the ends of the receiving supports.

The general functioning of the rail transport unit during loading/unloading, which differs little from one variant to another, will now be explained.

In general terms, several ways of carrying out the loading/unloading operations prove to be possible with the rail transport unit according to the invention.

The following methods of loading/unloading can be distinguished.

First of all there is vertical loading/unloading using external handling means.

Next there is in-line or longitudinal loading/unloading, according to which the set of rail transport units is separated at the axle unit or bogie on which the open end of the carrier structure is mounted without any movement other than that of connection to and disconnection from the axle unit or bogie.

Finally there is oblique loading/unloading, referred to as angled loading/unloading, in which the front ends of the railroad carrier structures are disengaged from the corresponding axle unit by a movement consisting of lifting and then rotation, until an obliquely offset position is reached, allowing longitudinal entry into the carrier structure through its rear end opening.

The various methods of loading/unloading will be described below in greater detail, more particularly with reference to FIGS. 13 to 28.

The simplest and most conventional method concerns vertical disconnection and transportation by an external lifting device (FIGS. 13 to 16).

It suffices to release any safety catches or locks in the vertical direction and to lift the whole by means of a lifting device, the gripping components and members of which bear on technical forms and structures specially provided for this purpose.

This lifting of the whole makes it possible to extract the rail transport unit from the train as a whole and with its load, and deposit it elsewhere temporarily or install it with its load on another railroad train.

FIGS. 13 to 16 show the structure loaded with a semi-trailer separated from the train by lifting by means of a crane or gantry.

This enables the destination of a load to be changed easily, advantageously replacing marshalling.

The second method concerns in-line or longitudinal loading/unloading (FIGS. 17 to 22). The movements are shown by arrows.

This method of loading/unloading requires a loading area with rails integrated in the ground.

According to this method, the rail transport unit is connected or disconnected by means of a vertical lifting or translational movement, or the two in combination, of its open transverse end, said connection/disconnection movement being effected by the integral lifting means, for example the extendable support props, and/or by external means. The disconnection makes it possible to release the axle unit or bogie, on the interface of which were mounted the ends of the side pieces. The road unit is loaded or unloaded, either directly along the linear carrier structures provided for movement, integral with the freight car, or indirectly, by means of one or more transverse carrier structures able to move along the freight car structure, on which the running gear of the road unit rests.

This road unit is coupled or fixed to, or uncoupled from, a tractor unit 44, with a view to its being brought or taken away in line on the dock, following the general direction of the railroad train.

A rear end with a deep, recessed opening enables the tractor unit 44 to remain on the ground during the manoeuvres involving bringing or taking away the semi-trailer.

The oblique loading/unloading operations, referred to as angled operations, enabling all these operations to be carried out without modifying the railroad train in any way, that is to say independently of the other rail units which may form it, will now be examined (FIGS. 23 to 28). The movements are shown by arrows.

The loading/unloading is carried out by moving the front end at an angle, after disconnection from the front axle unit or bogie, by any means, for example by means of the props, then shifting at an angle by travelling on the loading dock, during which operation the carrier structure pivots as a whole about its rear end, bearing pivotally on the rear axle unit or bogie. The freight car structure is lowered until the loading end is in contact with the ground. The running gear of the road unit to be loaded is carried by the internal linear carrier structures 23 and 24 or mounted on the transverse carrier structures, which may be cradles or carriages. Movement along the side pieces 8 and 9 or 96 and 97, towards or away from its transportation position, is provided by integral drive means or preferably by the road-going tractor vehicle.

The carrier structure is then shifted laterally towards the axle unit or bogie by means of a pivoting movement of the whole in the same way as previously, but in reverse order.

The lifting means, for example integral lifting means in the form of props, raise the front ends of the side pieces and place them opposite the fixing/locking means provided on the interface of the axle unit or bogie.

After coupling and locking, the carrier structure is ready in the train with its new load for the purpose of transportation by rail.

All the unloading operations are carried out in reverse order to the loading operations.

Lifting means at the rear end, either integral with the freight car structure or external, will, after the opening of the additional locking devices, enable the joining means to be disconnected and the freight car structure to be separated from the bogie interface. A rotation movement about the front end will ensure the release of the rear end by means of an angular shift.

Means of lifting the two ends will enable the freight car structure to be removed by means of a transverse or longitudinal shift.

The following three loading/unloading methods may be followed without any difficulty for the variant with centering posts:

the oblique method, referred to as the "angled" method, by unlocking and then uncoupling the rear end and pivoting at an angle about the front end;

the vertical method, by unlocking and then simultaneous vertical uncoupling movements of the two ends by means of an external or integral lifting device and removal by lifting the whole;

the horizontal method, by unlocking and then uncoupling either of the two front and rear ends and either of the following shifting stages:

lateral shifting by the two ends and with external means, longitudinal shifting by separation of the rear end and using integral means.

Although the last variant described is more particularly oriented towards in-line or oblique loading/unloading, loading/unloading in vertical mode can be envisaged in the case of a possible vertical disconnection of the front end.

The means described above will offer the possibility of choosing and implementing the loading/unloading method which is most suited to the load (container, road-going unit or other) and to the configuration of the handling area at the station, the train and the constraints and particular features of the marshalling operation.

What is claimed is:

1. A rail transport unit interconnecting first and second spaced apart axle units with one another, the rail transport unit comprising a freight car structure formed by two parallel sidepieces being separated from one another by a bed, a first end of the freight car structure having two sidepieces defining, with the bed, a traverse opening sized to facilitate at least one of loading and unloading of a road-traveling load onto and off from the freight car structure, the first end of said freight car structure having two parallel arm extensions being coupled to an associated composite interface of said first axle unit, and said first end of said freight car structure being separable from the associated composite interface of said first axle unit to facilitate providing free passage for the road-traveling load onto and of from the bed via the transverse opening;

wherein a second end of said freight car structure has two converging arm extensions which converge at an apex to merge the two sidepieces with one another.

2. The transport unit according to claim 1, wherein each composite interface is fixed to the associated axle unit.

3. The transport unit according to claim 1, wherein each composite interface comprises at least one of the following:

a haulage pivoting mechanism to facilitate pivoting with respect to the composite interface;

a mechanism for coupling and locking with the one of the first and second ends of the freight car structure to the composite interface;

a mechanism for transmitting tractive force, and a mechanism for damping shock transmitted to the said freight car structure.

4. The transport unit according to claim 3, wherein the mechanism for transmitting tractive force includes buffers and a coupling hook.

5. The transport unit according to claim 1, wherein each composite interface comprises a mechanism for transmitting tractive force, and the mechanism for transmitting tractive force is a mechanical interface structure.

6. The transport unit according to claim 1, wherein a movement and support mechanism is positioned along an internal surface of each sidepiece of said freight car structure to facilitate at least one of supporting, positioning and extracting the road-traveling load from said freight car structure.

7. The transport unit according to claim 6, wherein the movement and support mechanism comprises one of rolling tracks, sliding tracks and guiding tracks positioned longitudinally along the inwardly facing surfaces of the parallel sidepieces.

8. The transport unit according to claim 1, wherein the bed is a sunken bed supported by a portion of the parallel sidepieces located proximate a ground surface.

9. The transport unit according to claim 1, wherein at least one of the composite interfaces has a double pivoting articulation formed by a haulage articulation and a loading and unloading articulation.

10. The transport unit according to claim 9, wherein the double pivoting articulation is common to two successive freight car structures which are both coupled to one of the first and second axle units.

11. The transport unit according to claim 9, wherein the first end of the freight car structure is connected to the associated composite interface by the double pivoting articulation.

12. The transport unit according to claim 1, wherein a mechanism for pivoting, with respect to one of the associated first and second axle units, is provided at said apex of the freight car structure so as to enable said freight car structure to be pivoted and facilitate free passage for the road-traveling load onto and off from the bed via the transverse opening.

13. The transport unit according to claim 12, wherein the freight car structure has a mechanism which facilitates gripping and vertical raising of the freight car structure from the first and second axle units.

14. The transport unit according to claim 1, wherein the freight car structure has a mechanism, located on each of the two parallel sidepieces, for supporting the road-traveling load during transit.

15. The transport unit according to claim 1, wherein the first end of the freight car structure is separable from the associated composite interface of the first axle unit by a vertical lifting motion of the first end.

16. The transport unit according to claim 1, wherein the first end of said freight car structure includes both an integral lifting mechanism and a mechanism for facilitating traveling on a ground surface to move the first end of said freight car structure, relative to the second axle unit, and facilitate disconnection of the first end from the associated composite interface of the first axle unit to enable at least one of loading and unloading of the road-traveling load onto and off from the freight car structure.

17. The transport unit according to claim 1, wherein the bed functions as an access ramp to allow both loading and unloading of the road-traveling load.

18. A transport unit having a connecting freight car structure resting on first and second spaced apart axle units for at least one of loading, unloading and transportation of a load by rail, said transport unit comprising two longitudinal sides each having a front end and an opposed rear end, the front end of the two sides having arms converging at an apex to provide a mechanism which facilitates connection to the first of the two spaced apart axle units and support and pivoting of said freight car structure about the first of the two spaced apart axle units, and the rear end having two parallel arms engaging with end portions of a transverse support carried by the second of said spaced apart axle units, said two longitudinal sides being transversely connected with one another by a support surface for supporting the load, the front end of the said freight car structure having a vertical lifting mechanism and a transverse haulage mechanism, and the two longitudinal sides having, along each inwardly facing face, supports for supporting the load.

19. The transport unit according to claim 18, wherein the parallel arms define, at said first end adjacent the support surface, an access opening and at each end of said parallel arms is a rear supporting and pivoting extension, said extension is mounted so as to be separable from a pivoting carrier support provided by least one of said two axle units.

20. The transport unit according to claim 19, wherein the access opening of the rear end is a deep cutout provided in a longitudinal direction of the said freight car structure.

21. The transport unit according to claim 20, wherein the access opening of the rear end is a deep cutout which results from spacing a rear transverse edge of a bed remote from the rear end of said freight car structure.

22. The transport unit according to claim 18, wherein the vertical lifting mechanism is a pair of spaced apart and extendable props, and each said spaced apart and extendable prop is attached to the front end of each of the two longitudinal sides adjacent a base of said freight car structure.

23. The transport unit according to claim 22, wherein the extendable props are located on opposed sides of the access ramp for said freight car structure.

24. The transport unit according to claim 22, wherein the transverse haulage mechanism comprises rollers that are supported on a bottom surface of the two longitudinal sides adjacent the front end.

25. The transport unit according to claim 18, wherein each the first and second axle units has a traverse support which is a pivoting carrier cross member to facilitate pivoting of the rear end of said freight car structure.

26. The transport unit according to claim 25, wherein the pivoting carrier cross member is a single pivoting piece which is common to two successively arranged and coupled freight car structures.

27. The transport unit according to claim 25, wherein the pivoting cross member, mounted on each of said first and second axle units, is an assembly which has at least one of posts and locking devices.

28. The transport unit according to claim 25, wherein the pivoting cross member, of each of the first and second axle units, is symmetrical on each side of a central pivoting point of the pivoting cross member.

29. The transport unit according to claim 18, wherein pivoting of the traverse support, with respect to one of the first and second axle units, is independent of the pivoting of the freight car structure with respect to one of the first and second axle units.

30. The transport unit according to claim 29, wherein the traverse support of each of the first and second axle units is a pivoting cross member mounted on a center bearing of each respective first and second axle unit.

31. The transport unit according to claim 30, wherein the pivoting cross member and the apex of the two arms of the freight car structure are connected to the center bearing of the first axle unit by a common articulated pivoting assembly, the apex of the freight car structure is separable from the common articulated assembly by vertical movement and an adjacent end of a subsequent freight car structure is also coupled to the common articulated pivoting assembly and is separable therefrom by at least one of vertical movement and horizontal movement.

32. The transport unit according to claim 31, wherein the pivoting cross member has, at each opposed end thereof, receiving supports which receive and provide an immobilized coupling with the two parallel arms of an adjacent freight car structure.

33. The transport unit according to claim 32, wherein the receiving supports are centering posts which cooperate with tapered bores provided in the two parallel arms of the adjacent freight car structure to facilitate engagement therebetween.

34. The transport unit according to claim 32, wherein the receiving supports each comprise a cradle shape which is open at a top and has converging entry ramps, each receiving support has a transverse immobilization pin which cooperates with an end portion of each of the two parallel arms, and each parallel arm is equipped with a receiving member which engages with the immobilizing pin to provide a locking engagement therebetween and the immobilizing pin is extractable from the receiving member by operation of a rocker.

35. The transport unit according to either of claim 31, wherein the apex is a V-shaped front end formed by two parallel plates separated from one another by a spacer, and said pivoting cross member is sandwiched between said two parallel plates.

36. The transport unit according to claim 35, wherein the V-shaped front end is formed by a single plate positioned above the pivoting cross member and the V-shaped front end can be separated vertically from one of the first and second axle units without requiring the pivoting cross member to move vertically.

37. A method of loading and unloading a road-traveling load onto and off from a section of a railroad train via a rail transportation unit interconnecting first and second spaced apart axle units with one another, the rail transport unit comprising a freight car structure formed by two parallel sidepieces being separated from one another by a bed, a first end of the two sidepieces of said freight car structure defining, with the bed, a traverse opening sized to facilitate at least one of loading and unloading of a road-traveling load onto and off from the freight car structure, the first end of said freight car structure being mounted on the first of the two axle units by two sidepiece parallel arm extensions coupled to an associated composite interface of the first said axle unit, and said first end of said freight car structure being separable from the associated composite interface of the first said axle unit to facilitate providing free passage for the road-traveling load onto and off from the bed via the transverse opening; wherein a second end of said freight car structure has two converging arm extensions which converge at an apex to merge the two sidepieces with one another;

the method comprising the steps of:

disconnecting said first end of said freight car structure from the associated composite interface of the first axle unit;

pivoting said freight car structure relative to the said second axle unit;

lowering said first end of said freight car structure so that a base of said freight car structure contacts a support surface;

loading the road-traveling load onto said freight car structure;

raising the first end of said freight car structure; and reconnecting said first end of said freight car structure with the associated composite interface of the first axle unit to facilitate travel of said freight car structure along a railway.

38. The method according to claim 37, further comprising the step of providing linear movement to the road-traveling load, relative to the freight car structure, to facilitate loading of the road-traveling load into a transportation position.

39. The method according to claim 37, further comprising the steps of:

simultaneously disconnecting both said first end and said second end of said freight car structure from the associated first and second axle units and raising said freight car structure;

moving the raised freight car structure laterally with respect to both the first and second axle units; and lowering the freight car structure onto a support surface where the freight car structure can be one of loaded and unloaded with the road-traveling load.

40. The method according to claim 39, further comprising the steps of:

simultaneously disconnecting both said first end and said second end of said freight car structure from the associated first and second axle units and raising said freight car structure;

moving the raised freight car structure laterally with respect to both the first and second axle units; and connecting another freight car structure to said first and second spaced apart axles.

41. The method according to claim 37, further comprising the step of fixing the freight car structure to a composite interface of an axle unit coupled to two successively arranged freight car structures so as to enable each of the freight car structures to be independently connected and disconnected from the composite interface.

42. The method according to claim 37, further comprising the step of providing an interface for one of the first and second single axle units which is suitable for a single freight car structure and is provided with buffers.

43. The method according to claim 37, further comprising the steps of integrally forming, along inwardly facing surfaces of the freight car structure, a movement and support mechanism comprise to moving the road-traveling load relative to the freight car structure.

44. The method according to claim 37, further comprising the step of using one of rolling tracks, sliding tracks and guiding tracks as the movement and support mechanism.

45. The method according to claim 37, further comprising the steps of:

forming the freight car structure as an articulated road vehicle; and supporting a plurality of vehicles, on the articulated road vehicle, to facilitate transportation of the articulated road vehicle, laden with vehicles, along a railway.

* * * * *